US012736265B2

(12) United States Patent
Lee et al.

(10) Patent No.: US 12,736,265 B2
(45) Date of Patent: Sep. 15, 2026

(54) REFRIGERATOR AND CONTROL METHOD THEREFOR

(71) Applicant: LG ELECTRONICS INC., Seoul (KR)

(72) Inventors: Donghoon Lee, Seoul (KR); Wookyong Lee, Seoul (KR); Seungseob Yeom, Seoul (KR); Donghoon Lee, Seoul (KR); Yongjun Bae, Seoul (KR); Sunggyun Son, Seoul (KR); Chongyoung Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/385,070

(22) Filed: Oct. 30, 2023

(65) Prior Publication Data

US 2024/0093928 A1 Mar. 21, 2024

Related U.S. Application Data

(63) Continuation of application No. 17/282,376, filed as application No. PCT/KR2019/012869 on Oct. 1, 2019, now Pat. No. 11,835,283.

(30) Foreign Application Priority Data

Oct. 2, 2018 (KR) ..... 10-2018-0117782
Oct. 2, 2018 (KR) ..... 10-2018-0117785
(Continued)

(51) Int. Cl.
*F25C 5/08* (2006.01)
*F25C 1/18* (2006.01)
(Continued)

(52) U.S. Cl.
CPC ..... *F25C 5/08* (2013.01); *F25C 1/18* (2013.01); *F25C 1/24* (2013.01); *F25C 1/25* (2018.01);
(Continued)

(58) Field of Classification Search
CPC .... F25C 5/08; F25C 2400/10; F25C 2400/06; F25C 1/25; F25C 1/24; F25C 1/18; F25D 29/00
See application file for complete search history.

(56) References Cited

U.S. PATENT DOCUMENTS 3,318,105 A 5/1967 Burroughs et al.
3,952,539 A * 4/1976 Hanson ..... F25C 1/18 62/351
(Continued)

FOREIGN PATENT DOCUMENTS

CN 1435621 8/2003
EP 2549207 1/2013
(Continued)

OTHER PUBLICATIONS

Translated_Norihiro (Year: 1994).*
(Continued)

*Primary Examiner* — Jerry-Daryl Fletcher
*Assistant Examiner* — Samba Gaye
(74) *Attorney, Agent, or Firm* — KED & ASSOCIATES, LLP

(57) ABSTRACT

A method for controlling a refrigerator of the present invention includes turning on the heater when ice making is completed; moving the second tray to a standby position in a forward direction when the movement condition of the second tray is satisfied; turning off the heater when a turn-off condition of the heater is satisfied after the second tray moves to the standby position in the forward direction;
(Continued)

determining whether the heater is turned off and a predetermined time has elapsed; and moving the second tray to the ice separation position in the forward direction when it is determined that the predetermined time has elapsed.

21 Claims, 13 Drawing Sheets

(30) Foreign Application Priority Data

| | | |
|---|---|---|
| Oct. 2, 2018 | (KR) | 10-2018-0117819 |
| Oct. 2, 2018 | (KR) | 10-2018-0117821 |
| Oct. 2, 2018 | (KR) | 10-2018-0117822 |
| Nov. 16, 2018 | (KR) | 10-2018-0142117 |
| Jul. 6, 2019 | (KR) | 10-2019-0081719 |

(51) Int. Cl.
*F25C 1/24* (2018.01)
*F25C 1/25* (2018.01)
*F25D 29/00* (2006.01)

(52) U.S. Cl.
CPC ..... *F25D 29/00* (2013.01); *F25C 2400/06* (2013.01); *F25C 2400/10* (2013.01)

(56) References Cited

U.S. PATENT DOCUMENTS

| | | | | |
|---|---|---|---|---|
| 4,910,974 | A | 3/1990 | Hara | |
| 9,151,527 | B2 | 10/2015 | Boarman et al. | |
| 2007/0137241 | A1 | 6/2007 | Lee et al. | |
| 2010/0218518 | A1* | 9/2010 | Ducharme | F25D 21/14 62/340 |
| 2010/0218542 | A1* | 9/2010 | McCollough | F25D 11/022 700/275 |
| 2013/0014536 | A1* | 1/2013 | Son | F25C 1/25 62/340 |
| 2013/0081412 | A1* | 4/2013 | Son | F25C 5/04 62/340 |
| 2013/0327082 | A1 | 12/2013 | Son et al. | |
| 2014/0165598 | A1* | 6/2014 | Boarman | F25C 1/22 62/347 |
| 2014/0182325 | A1 | 7/2014 | Lee et al. | |
| 2017/0089629 | A1* | 3/2017 | Ji | F25C 5/08 |
| 2017/0122644 | A1* | 5/2017 | Je | F25C 5/08 |
| 2018/0187941 | A1 | 7/2018 | An et al. | |
| 2018/0231294 | A1 | 8/2018 | Song et al. | |
| 2020/0340726 | A1* | 10/2020 | Song | F25C 1/18 |

FOREIGN PATENT DOCUMENTS

| | | |
|---|---|---|
| EP | 2910876 | 8/2015 |
| EP | 3059526 | 8/2016 |
| JP | H01-234768 | 9/1989 |
| JP | H04-313662 | 11/1992 |
| JP | H05-164441 | 6/1993 |
| JP | H05-203299 | 8/1993 |
| JP | H05-203302 | 8/1993 |
| JP | H05203299 A * | 8/1993 |
| JP | H06-74624 | 3/1994 |
| JP | H0674624 A * | 3/1994 |
| JP | H06-070543 | 9/1994 |
| JP | H06-273014 | 9/1994 |
| JP | H09-269172 | 10/1997 |
| JP | 2001-289544 | 10/2001 |
| JP | 2002-350019 | 12/2002 |
| JP | 2003-232587 | 8/2003 |
| JP | 2005326035 | 11/2005 |
| JP | 4572833 | 11/2010 |
| JP | 2011-064371 | 3/2011 |
| JP | 2011064373 | 3/2011 |
| JP | 2011-237077 | 11/2011 |
| KR | 2003-0051546 | 6/2003 |
| KR | 10-2005-0041252 | 5/2005 |
| KR | 10-2005-0069319 | 7/2005 |
| KR | 10-2005-0096336 | 10/2005 |
| KR | 10-2005-0099887 | 10/2005 |
| KR | 10-2006-0027467 | 3/2006 |
| KR | 10-2008-0001004 | 1/2008 |
| KR | 10-0833860 | 5/2008 |
| KR | 10-2009-0007922 | 1/2009 |
| KR | 10-2009-0077252 | 7/2009 |
| KR | 10-2009-0079377 | 7/2009 |
| KR | 10-0935746 | 1/2010 |
| KR | 10-2011-0037609 | 4/2011 |
| KR | 10-2012-0003233 | 1/2012 |
| KR | 10-2013-0009332 | 1/2013 |
| KR | 10-2013-0009521 | 1/2013 |
| KR | 20130009332 | 1/2013 |
| KR | 10-2014-0088321 | 7/2014 |
| KR | 10-2016-0004880 | 1/2016 |
| KR | 10-2016-0046551 | 4/2016 |
| KR | 10-1643635 | 7/2016 |
| KR | 10-2016-0148290 | 12/2016 |
| KR | 10-2017-0052235 | 5/2017 |
| KR | 10-1850918 | 5/2018 |
| KR | 10-2018-0093666 | 8/2018 |
| KR | 10-2018-0100752 | 9/2018 |

OTHER PUBLICATIONS

Translated_Shuzo (Year: 1993).*
Korean Notice of Allowance dated Nov. 7, 2023, issued in Application No. 10-2018-0117821.
Korean Notice of Allowance dated Jan. 10, 2024 issued in Application No. 10-2018-0142117.
Korean Notice of Allowance dated Feb. 22, 2024 issued in Application No. 10-2018-0117785.
Korean Office Action dated Mar. 12, 2024 issued in Application No. 10-2018-0117822.
International Search Report (with English Translation) and Written Opinion (with English Translation) dated Jan. 28, 2020 issued in Application No. PCT/KR2019/012869.
Chinese Office Action dated May 26, 2022 issued in Application No. 201980063985.3.
Extended European Search Report dated Jul. 13, 2022 issued in Application No. 19868945.7.
Korean Office Action dated May 8, 2023 issued in Application No. 10-2018-0117819.
Korean Office Action dated Apr. 18, 2023 issued in Application No. 10-2018-0117782.
Korean Office Action dated May 14, 2023 issued in Application No. 10-2018-0117821.
Korean Office Action dated May 15, 2023 issued in Application No. 10-2018-0117822.
Korean Office Action dated May 1, 2023 issued in Application No. 10-2018-0117785.
Korean Office Action dated Jul. 4, 2023 issued in Application No. 10-2018-0142117.
Korean Office Action dated Oct. 23, 2023, issued in Application No. 10-2018-0117782.
U.S. Office Action dated Sep. 22, 2022 issued in U.S. Appl. No. 17/282,376.
U.S. Office Action dated Apr. 14, 2023 issued in U.S. Appl. No. 17/282,376.
Translated_Keiji (Year: 1992).
Translated_Ji (Year: 2003).
Translated_Yoshikazu (Year: 1994).
Korean Office Action dated May 1, 2024 issued in Application No. 10-2019-0081719.
Korean Office Action dated Jun. 19, 2024 issued in Application No. 10-2018-0117819.
Korean Office Action dated Aug. 12, 2024 issued in Application No. 10-2018-0117822.

(56) References Cited

OTHER PUBLICATIONS

Korean Notice of Allowance dated Nov. 19, 2024 issued in Application No. 10-2024-0018570.

* cited by examiner

REFRIGERATOR AND CONTROL METHOD THEREFOR

CROSS-REFERENCE TO RELATED PATENT APPLICATIONS

This application is a Continuation of U.S. patent application Ser. No. 17/282,376, filed Apr. 1, 2021, which is a U.S. National Stage Application under 35 U.S.C. § 371 of PCT Application No. PCT/KR2019/012869, filed Oct. 1, 2019, which claims priority to Korean Patent Application Nos. 10-2018-0117819, filed Oct. 2, 2018, 10-2018-0117821, filed Oct. 2, 2018, 10-2018-0117822, filed Oct. 2, 2018, 10-2018-0117785, filed Oct. 2, 2018, 10-2018-0117782, filed Oct. 2, 2018, 10-2018-0142117, filed Nov. 16, 2018, and 10-2019-0081719, filed Jul. 6, 2019, whose entire disclosures are hereby incorporated by reference.

TECHNICAL FIELD

Embodiments provide a refrigerator and a method for controlling the same.

BACKGROUND ART

In general, refrigerators are home appliances for storing foods at a low temperature in a storage chamber that is covered by a door. The refrigerator may cool the inside of the storage space by using cold air to store the stored food in a refrigerated or frozen state. Generally, an ice maker for making ice is provided in the refrigerator. The ice maker makes ice by cooling water after accommodating the water supplied from a water supply source or a water tank into a tray. The ice maker may separate the made ice from the ice tray in a heating manner or twisting manner.

As described above, the ice maker through which water is automatically supplied, and the ice automatically separated may be opened upward so that the mode ice is pumped up.

As described above, the ice made in the ice maker may have at least one flat surface such as crescent or cubic shape.

When the ice has a spherical shape, it is more convenient to use the ice, and also, it is possible to provide different feeling of use to a user. Also, even when the made ice is stored, a contact area between the ice cubes may be minimized to minimize a mat of the ice cubes.

An ice maker is disclosed in Korean Registration No. 10-1850918 that is a prior art document.

The ice maker disclosed in the prior art document includes an upper tray in which a plurality of upper cells, each of which has a hemispherical shape, are arranged, and which includes a pair of link guide parts extending upward from both side ends thereof, a lower tray in which a plurality of upper cells, each of which has a hemispherical shape and which is rotatably connected to the upper tray, a rotation shaft connected to rear ends of the lower tray and the upper tray to allow the lower tray to rotate with respect to the upper tray, a pair of links having one end connected to the lower tray and the other end connected to the link guide part, and an upper ejecting pin assembly connected to each of the pair of links in at state in which both ends thereof are inserted into the link guide part and elevated together with the upper ejecting pin assembly.

In the case of the prior art document, the ice maker further includes an ice separation heater that contacts the upper tray for ice separation, but it is difficult to determine an appropriate ice separation time due to different ice separation time points between the plurality of cells.

In addition, in the case of the prior art document, there are problems that, as the ice separation time points are different between the plurality of cells, excessive melting is made by the heat of the ice separation heater in some cells, the surface of the ice becomes opaque or non-smooth, and the melting water descends into the ice bin and thus a mat of the ice cubes is generated inside the ice bin.

DISCLOSURE

Technical Problem

Embodiments provide a refrigerator in which ice separation is smoothly performed by determining an appropriate ice separation time point in an ice maker including a plurality of cells, and a method for controlling the same.

Embodiments provide a refrigerator which is capable of generating ice having a spherical smooth surface and uniform transparency as a whole, and a method for controlling the same.

Embodiments provide a refrigerator which can prevent the phenomenon that the melting water is settled inside the ice bin so that a mat of ice cubes is generated inside the ice bin or the ice inside the ice bin melts by the melting water, and a method for controlling the same.

Technical Solution

A method for controlling a refrigerator according to an aspect includes turning on the heater for ice separation when ice making is completed, moving the second tray to a standby position in a forward direction when the movement condition of the second tray is satisfied, turning off the heater when a turn-off condition of the heater is satisfied after the second tray moves to the standby position in the forward direction, determining whether the heater is turned off and a predetermined time has elapsed, and moving the second tray to the ice separation position in the forward direction when it is determined that the predetermined time has elapsed.

As an example, when the movement condition of the second tray is satisfied, the heater may be turned off, and when the second tray is moved to the standby position, the heater may be turned on again.

Whether the movement condition of the second tray is satisfied may be determined based on at least one of a turn-on time of the heater and a temperature sensed by a temperature sensor for sensing the temperature of the ice making cell.

When the turn-on time of the heater elapses a first reference time and the temperature sensed by the temperature sensor reaches a first turn-off reference temperature, it may be determined that the movement condition of the second tray is satisfied.

When the second reference time shorter than the first reference time elapses in a state in which the heater is turned on again, it may be determined that the turn-off condition of the heater is satisfied.

The predetermined time may be longer than the second reference time.

As another example, when the second tray moves to a standby position in a forward direction, the heater may be maintained in a turn-on state.

In addition, as an example in which the heater is turned off and a predetermined time lapses, the second tray may wait at the standby position until the predetermined time elapses after the heater is turned off.

As another example, the second tray may move to a specific position between the standby position and the ice separation position and may wait until the predetermined time elapses from the moved position after the heater is turned off.

The first tray may be formed of a metal material or a silicon material.

The refrigerator may further include a pusher having a length formed in a vertical direction of the ice making cell larger than a length formed in a horizontal direction of the ice making cell so that ice is easily separated from the first tray.

Meanwhile, an additional heater positioned at one side of the first tray or the second tray may be turned on in at least partial sections while the cold air supply part supplies cold air so that the bubbles dissolved in the water inside the ice making cell move from the ice-generating portion to the liquid water to generate transparent ice.

When the additional heater may be turned off and the temperature sensed by a temperature sensor for sensing the temperature of the ice making cell is equal to or less than a reference temperature, it is determined that ice making is completed and thus the heater is turned on.

Meanwhile, a refrigerator may include a first tray and a second tray configured to form a portion of an ice making cell, which is a space in which water is phase-changed into ice by the cold air, a heater configured to be positioned adjacent to at least one of the first tray and the second tray, and a controller configured to control the heater. The controller may control the heater to be turned on first so that ice is capable of being easily separated from the trays before the second tray moves to the ice separation position in the forward direction, and the controller may control the heater to be turned on secondly by moving the second tray to a standby position in the forward direction after the heater is turned off.

The controller may control the heater to be turned off when a turn-off condition of the heater is satisfied after the heater is secondly turned on and the second tray to wait at the standby position until a predetermined time elapse.

Advantageous Effects

According to the proposed invention, it is possible to secure the ice separation reliability by determining the optimal ice separation time point in an ice maker having different ice separation time points between respective cells, by including a plurality of cells.

In addition, after the tray is firstly heated by the ice separation heater, the lower tray is separated from the ice separation heater, thereby preventing excessive melting due to the difference in ice separation time point between ice making cells.

In addition, after separation of the lower tray from the ice separation heater, in the case of an ice making cell that has not yet reached the ice separation time point, it is possible to secure the ice separation reliability by making the ice making cell reach the ice separation time point through additional heating.

In addition, after additional heating, the water melting by the ice separation heater waits without ice separation for a predetermined time to cool, and thus the phenomenon that the melting water is settled in the ice bin, and a mat of the ice cubes is generated inside the ice bin or the ice inside the ice bin melts by the melting water can be prevented.

MODE FOR INVENTION

Figure 1:
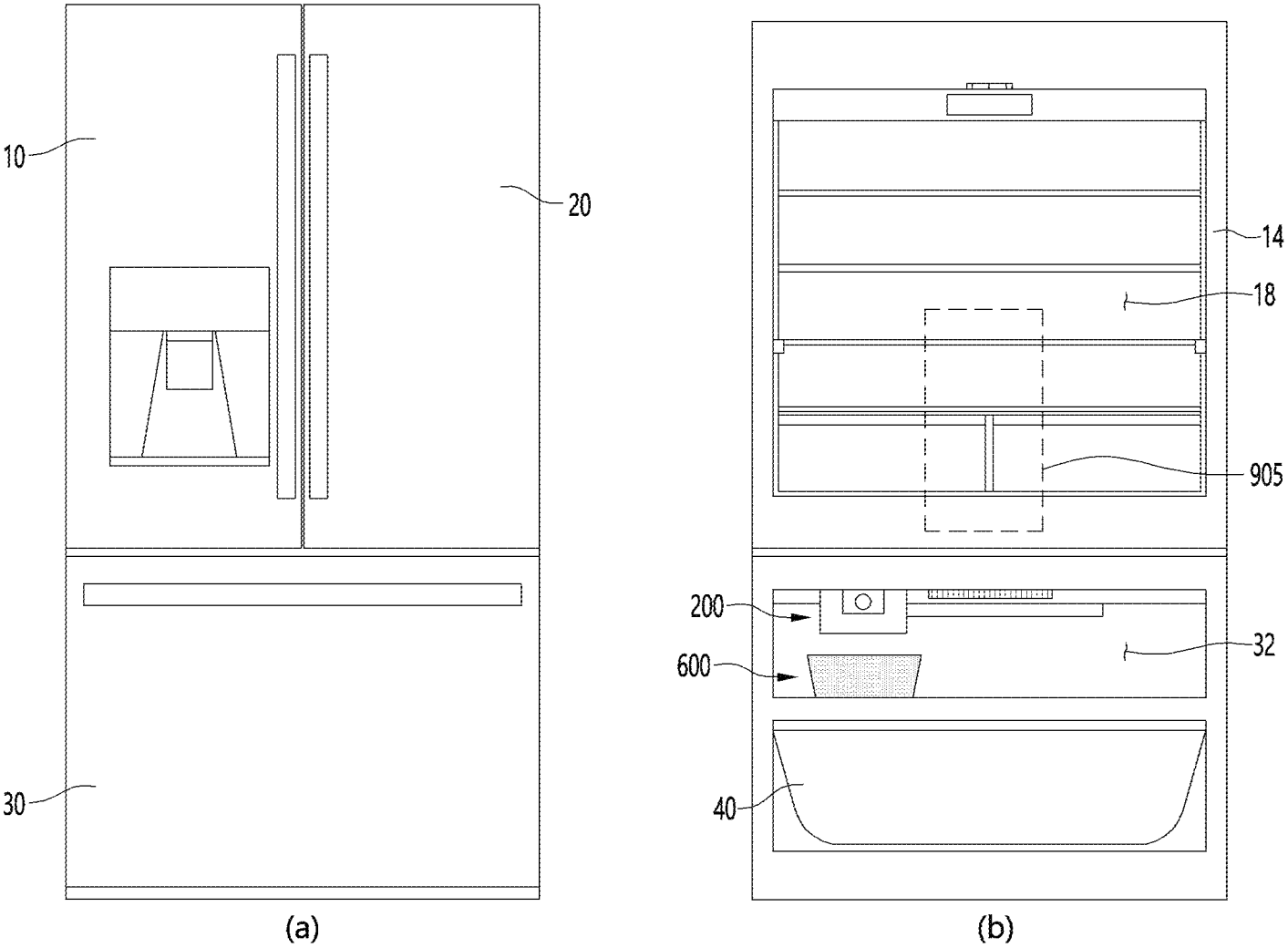
FIG. 1 is a front view of a refrigerator according to an embodiment.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

FIG. 1 is a front view of a refrigerator according to an embodiment.

Referring to FIG. 1, a refrigerator according to an embodiment may include a cabinet 14 including a storage chamber and a door that opens and closes the storage chamber.

The storage chamber may include a refrigerating compartment 18 and a freezing compartment 32. The refrigerating compartment 18 is disposed at an upper side, and the freezing compartment 32 is disposed at a lower side. Each of the storage chamber may be opened and closed individually by each door. For another example, the freezing compartment may be disposed at the upper side and the refrigerating compartment may be disposed at the lower side. Alternatively, the freezing compartment may be disposed at one side of left and right sides, and the refrigerating compartment may be disposed at the other side.

The freezing compartment 32 may be divided into an upper space and a lower space, and a drawer 40 capable of being withdrawn from and inserted into the lower space may be provided in the lower space.

The door may include a plurality of doors 10, 20, 30 for opening and closing the refrigerating compartment 18 and the freezing compartment 32. The plurality of doors 10, 20, and 30 may include some or all of the doors 10 and 20 for opening and closing the storage chamber in a rotatable manner and the door 30 for opening and closing the storage chamber in a sliding manner. The freezing compartment 32 may be provided to be separated into two spaces even though the freezing compartment 32 is opened and closed by one door 30.

In this embodiment, the freezing compartment 32 may be referred to as a first storage chamber, and the refrigerating compartment 18 may be referred to as a second storage chamber.

The freezing compartment 32 may be provided with an ice maker 200 capable of making ice. The ice maker 200 may be disposed, for example, in an upper space of the freezing compartment 32.

An ice bin 600 in which the ice made by the ice maker 200 falls to be stored may be disposed below the ice maker 200. A user may take out the ice bin 600 from the freezing compartment 32 to use the ice stored in the ice bin 600. The ice bin 600 may be mounted on an upper side of a horizontal wall that partitions an upper space and a lower space of the freezing compartment 32 from each other.

Although not shown, the cabinet 14 is provided with a duct supplying cold air to the ice maker 200. The duct guides the cold air heat-exchanged with a refrigerant flowing through the evaporator 905 to the ice maker 200. For example, the duct may be disposed behind the cabinet 14 to discharge the cold air toward a front side of the cabinet 14. The ice maker 200 may be disposed at a front side of the duct. Although not limited, a discharge hole of the duct may be provided in one or more of a rear wall and an upper wall of the freezing compartment 32.

Although the above-described ice maker 200 is provided in the freezing compartment 32, a space in which the ice maker 200 is disposed is not limited to the freezing compartment 32. For example, the ice maker 200 may be disposed in various spaces as long as the ice maker 200 receives the cold air.

Figure 2:
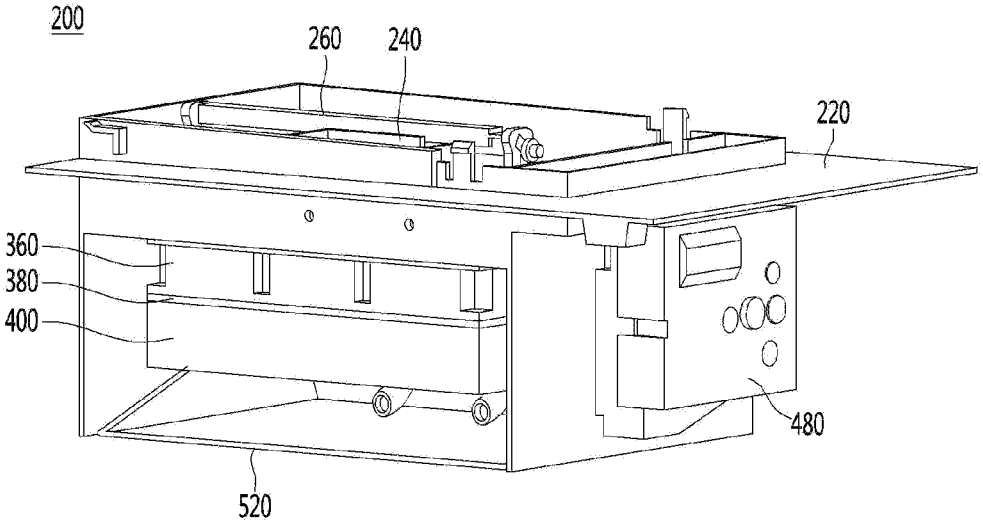
FIG. 2 is a perspective view of an ice maker according to an embodiment.
Figure 3:
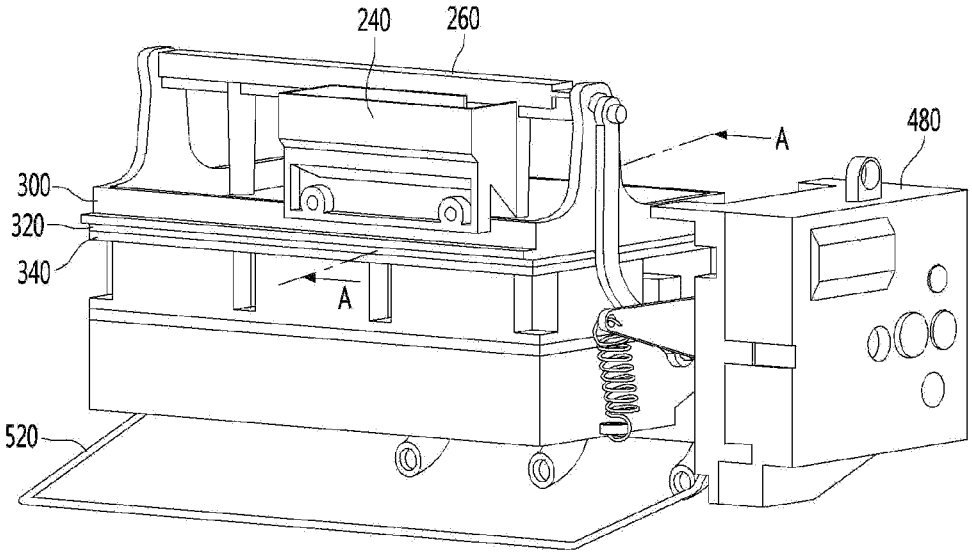
FIG. 3 is a perspective view illustrating a state in which a bracket is removed from the ice maker of FIG. 2.
Figure 4:
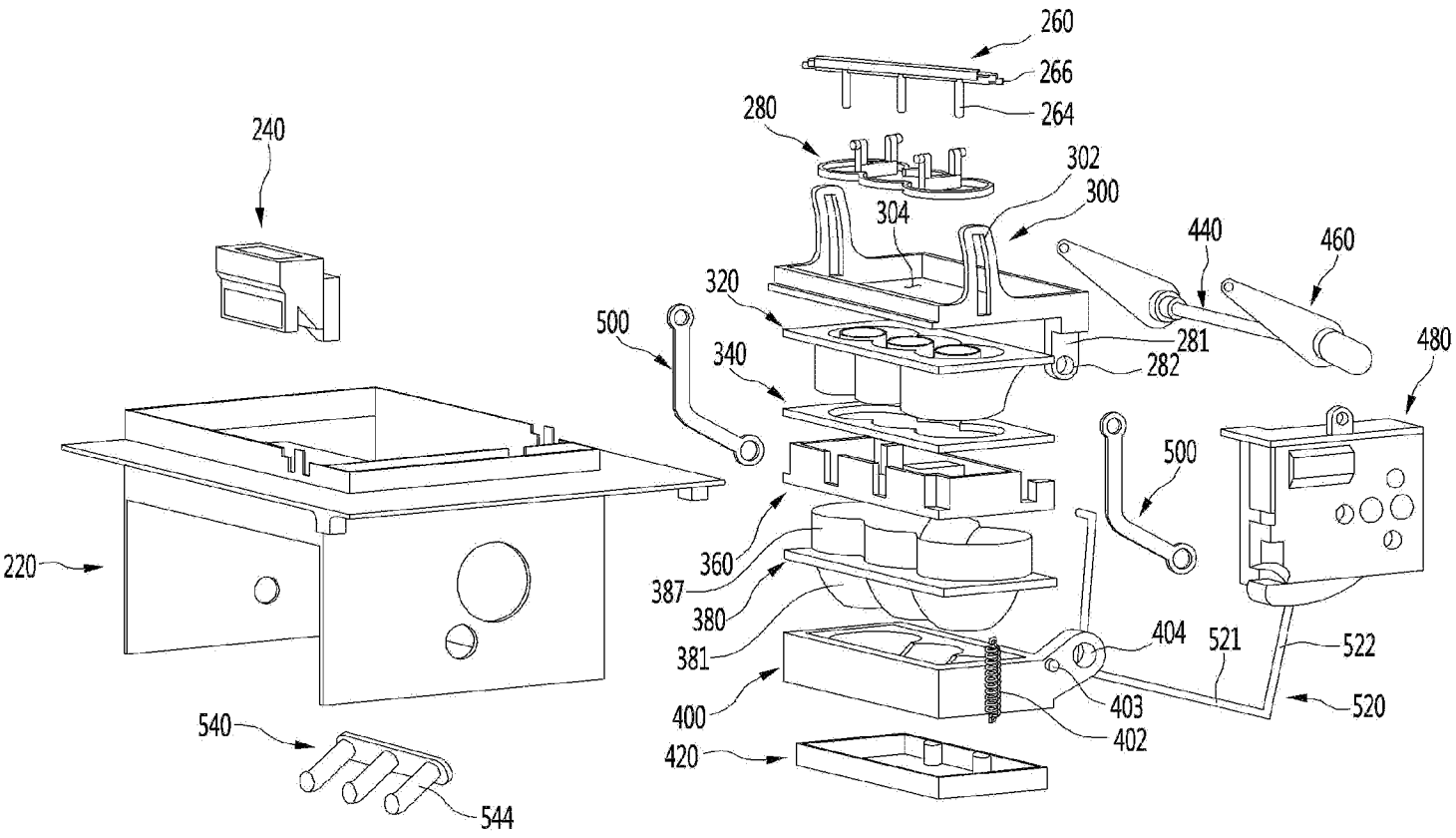
FIG. 4 is an exploded perspective view of the ice maker according to an embodiment.
Figure 5:
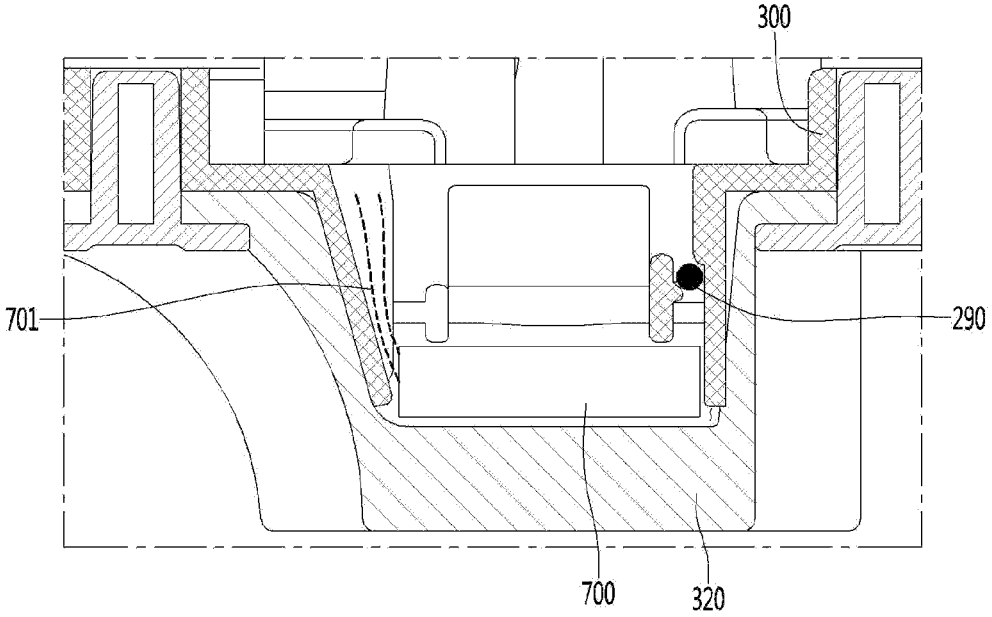
FIG. 5 is a cross-sectional view taken along line A-A of FIG. 3 for illustrating a second temperature sensor installed in the ice maker according to an embodiment of the present invention.

FIG. 2 is a perspective view of an ice maker according to an embodiment. FIG. 3 is a perspective view illustrating a state in which a bracket is removed from the ice maker of FIG. 2. FIG. 4 is an exploded perspective view of the ice maker according to an embodiment. FIG. 5 is a cross-sectional view taken along line A-A of FIG. 3 for illustrating a second temperature sensor installed in the ice maker according to an embodiment of the present invention.

Figure 6:
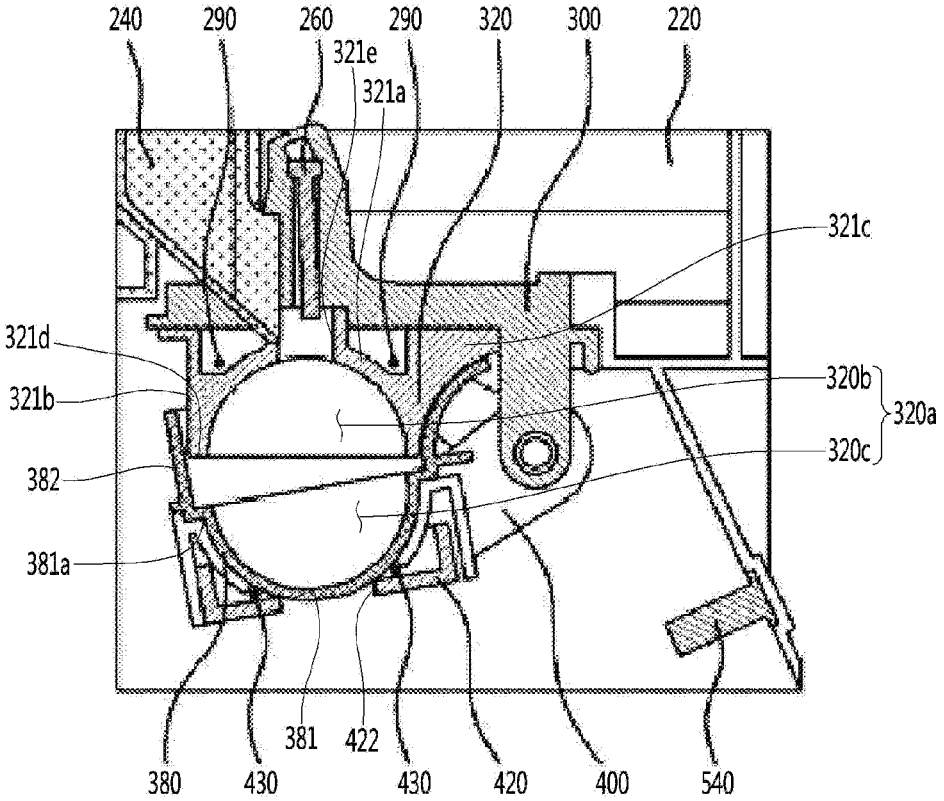
FIG. 6 is a longitudinal cross-sectional view of an ice maker when a second tray is positioned at a water supply position according to an embodiment of the present invention.

FIG. 6 is a longitudinal cross-sectional view of an ice maker when a second tray is positioned at a water supply position according to an embodiment of the present invention.

Referring to FIGS. 2 to 6, each component of the ice maker 200 may be provided inside or outside the bracket 220, and thus, the ice maker 200 may constitute one assembly.

The bracket 220 may be installed at, for example, the upper wall of the freezing compartment 32. A water supply part 240 may be installed above the inner surface of the bracket 220. The water supply part 240 is provided with openings at the upper and lower sides, respectively, so that water supplied to the upper side of the water supply part 240 may be guided to the lower side of the water supply part 240. The upper opening of the water supply part 240 is larger than the lower opening, and thus a discharge range of water guided downward through the water supply part 240 may be limited. A water supply pipe through which water is supplied may be installed above the water supply part 240. The water supplied to the water supply part 240 may move downward. The water supply part 240 may prevent the water discharged from the water supply pipe from dropping from a high position, thereby preventing the water from splashing. Since the water supply part 240 is disposed below the water supply pipe, the water may be guided downward without splashing up to the water supply part 240, and an amount of splashing water may be reduced even if the water moves downward due to the lowered height The ice maker 200 may include an ice making cell 320 in which water is phase-changed into ice by the cold air.

The ice maker 200 may include a first tray 320 forming at least a portion of a wall for providing the ice making cell 320*a*, and a second tray 380 forming at least another portion of the wall for providing the ice making cell 320*a*. Although not limited, the ice making cell 320*a* may include a first cell 320*b* and a second cell 320*c*. The first tray 320 may define the first cell 320*b*, and the second tray 380 may define the second cell 320*c*.

The second tray 380 may be disposed to be relatively movable with respect to the first tray 320. The second tray 380 may linearly rotate or rotate. Hereinafter, the rotation of the second tray 380 will be described as an example.

For example, in an ice making process, the second tray 380 may move with respect to the first tray 320 so that the first tray 320 and the second tray 380 contact each other. When the first tray 320 and the second tray 380 contact each other, the complete ice making cell 320*a* may be defined. On the other hand, the second tray 380 may move with respect to the first tray 320 during the ice making process after the ice making is completed, and the second tray 380 may be spaced apart from the first tray 320.

In this embodiment, the first tray 320 and the second tray 380 may be arranged in a vertical direction in a state in which the ice making cell 320*a* is formed. Accordingly, the first tray 320 may be referred to as an upper tray, and the second tray 380 may be referred to as a lower tray.

A plurality of ice making cells 320*a* may be defined by the first tray 320 and the second tray 380. Hereinafter, in FIG. 4, three ice making cells 320*a* are provided as an example.

When water is cooled by cold air while water is supplied to the ice making cell 320*a*, ice having the same or similar shape as that of the ice making cell 320*a* may be made. In this embodiment, for example, the ice making cell 320*a* may be provided in a spherical shape or a shape similar to a spherical shape. The ice making cell 320*a* may have a rectangular parallelepiped shape or a polygonal shape. In this case, the first cell 320*b* may have a hemispherical shape or a shape similar to that of a hemisphere. In addition, the second cell 320*c* may be formed in a hemispherical shape or a shape similar to that of a hemisphere.

The ice maker 200 may further include a first tray case 300 coupled to the first tray 320.

For example, the first tray case 300 may be coupled to an upper side of the first tray 320. The first tray case 300 and the bracket 220 may be integrally provided or coupled to each other with each other after being manufactured in separate configurations.

The ice maker 200 may further include a first heater case 280. An ice separation heater 290 may be installed in the first heater case 280. The first heater case 280 may be integrally formed with the first tray case 300 or may be separately formed. The ice separation heater 290 may be disposed at a position adjacent to the first tray 320. The ice separation heater 290 may be, for example, a wire type heater. For example, the ice separation heater 290 may be installed to contact the first tray 320 or may be disposed at a position spaced a predetermined distance from the first tray 320. In some case, the ice separation heater 290 may supply heat to the first tray 320, and the heat supplied to the first tray 320 may be transferred to the ice making cell 320*a*.

The ice maker 200 may further include a first tray cover 340 positioned below the first tray 320. The first tray cover 340 has an opening formed to correspond to the shape of the ice making cell 320*a* of the first tray 320 and thus may be coupled to the lower surface of the first tray 320.

The first tray case 300 may be provided with a guide slot 302 inclined at an upper side and vertically extending at a lower side. The guide slot 302 may be provided in a member extending upward from the first tray case 300. A guide protrusion 266 of the first pusher 260 to be described later may be inserted into the guide slot 302. Thus, the guide protrusion 266 may be guided along the guide slot 302.

The first pusher 260 may include at least one extension part 264. For example, the first pusher 260 may include an extension part 264 provided with the same number as the number of ice making cells 320*a*, but is not limited thereto. The extension part 264 may push out the ice disposed in the ice making cell 320*a* during the ice separation process. For example, the extension part 264 may be inserted into the ice making cell 320*a* through the first tray case 300. Therefore, the first tray case 300 may be provided with a hole 304 through which a portion of the first pusher 260 passes.

The guide protrusion 266 of the first pusher 260 may be coupled to a pusher link 500. In this case, the guide protrusion 266 may be coupled to the pusher link 500 so as to be rotatable. Therefore, when the pusher link 500 moves, the first pusher 260 may also move along the guide slot 302.

The ice maker 200 may further includes a second tray case 400 coupled to the second tray 380. The second tray case 400 may support the second tray 380 at a lower side of the second tray 380. For example, at least a portion of the wall defining a second cell 320*c* of the second tray 380 may be supported by the second tray case 400.

A spring 402 may be connected to one side of the second tray case 400. The spring 402 may provide elastic force to the second tray case 400 to maintain a state in which the second tray 380 contacts the first tray 320.

The ice maker 200 may further include a second tray cover 360.

The second tray 380 may include a circumferential wall 382 surrounding a portion of the first tray 320 in a state of contacting the first tray 320. The second tray cover 360 may cover at least a portion of the circumferential wall 382.

The ice maker 200 may further include a second heater case 420. A transparent ice heater 430 may be installed in the second heater case 420.

The transparent ice heater 430 will be described in detail.

The controller 800 according to this embodiment may control the transparent ice heater 430 so that heat is supplied to the ice making cell 320*a* in at least partial sections while cold air is supplied to the ice making cell 320*a* to make the transparent ice.

An ice making rate may be delayed so that bubbles dissolved in water within the ice making cell 320*a* may move from a portion at which ice is made toward liquid water by the heat of the transparent ice heater 430, thereby making transparent ice in the ice maker 200. That is, the bubbles dissolved in water may be induced to escape to the outside of the ice making cell 320*a* or to be collected into a predetermined position in the ice making cell 320*a*.

When a cold air supply part 900 to be described later supplies cold air to the ice making cell 320*a*, if the ice making rate is high, the bubbles dissolved in the water inside the ice making cell 320*a* may be frozen without moving from the portion at which the ice is made to the liquid water, and thus, transparency of the ice may be reduced.

On the contrary, when the cold air supply part 900 supplies the cold air to the ice making cell 320*a*, if the ice making rate is low, the above limitation may be solved to increase in transparency of the ice. However, there is a limitation in which a making time increases.

Accordingly, the transparent ice heater 430 may be disposed at one side of the ice making cell 320*a* so that the heater locally supplies heat to the ice making cell 320*a*, thereby increasing in transparency of the made ice while reducing the ice making time.

When the transparent ice heater 430 is disposed on one side of the ice making cell 320*a*, the transparent ice heater 430 may be made of a material having thermal conductivity less than that of the metal to prevent heat of the transparent ice heater 430 from being easily transferred to the other side of the ice making cell 320*a*.

At least one of the first tray 320 and the second tray 380 may be a resin including plastic so that the ice attached to the trays 320 and 380 is separated well during the ice separation process.

At least one of the first tray 320 and the second tray 380 may be made of flexible material or soft material so that the tray deformed by the pushers 260 and 540 can be easily restored to the original shape thereof during the ice separation process.

The transparent ice heater 430 may be disposed at a position adjacent to the second tray 380. The transparent ice heater 430 may be a wire type heater, as an example. As an example, the transparent ice heater 430 may be installed to contact the second tray 380 or may be disposed at a position spaced apart from the second tray 380 by a predetermined distance. As another example, the second heater case 420 may not be separately provided, and the transparent ice heater 430 may be installed in the second tray case 400.

In some cases, the transparent ice heater 430 may supply heat to the second tray 380, and the heat supplied to the second tray 380 may be transferred to the ice making cell 320*a*.

The ice maker 200 may further include a driver 480 that provides driving force. The second tray 380 may relatively move with respect to the first tray 320 by receiving the driving force of the driver 480.

A through-hole 282 may be defined in an extension part 281 extending downward in one side of the first tray case 300. A through-hole 404 may be defined in the extension part 403 extending in one side of the second tray case 400. At least a portion of the through-hole 404 may be disposed at a position higher than a horizontal line passing through a center of the ice making cell 320*a*. The ice maker 200 may further include a shaft 440 that passes through the through-holes 282 and 404 together.

A rotation arm 460 may be provided at each of both ends of the shaft 440. The shaft 440 may rotate by receiving rotational force from the driver 480.

One end of the rotation arm 460 may be connected to one end of the spring 402, and thus, a position of the rotation arm 460 may move to an initial value by restoring force when the spring 402 is tensioned The driver 480 may include a motor and a plurality of gears.

A full ice detection lever 520 may be connected to the driver 480. The full ice detection lever 520 may also rotate by the rotational force provided by the driver 480.

The full ice detection lever 520 may have a E shape as a whole. For example, the full ice detection lever 520 may include a first portion 521 and a pair of second portions 522 extending in a direction crossing the first portion 521 at both ends of the first portion 521. One of the pair of second portions 522 may be coupled to the driver 480, and the other may be coupled to the bracket 220 or the first tray case 300.

The full ice detection lever 520 may rotate to detect ice stored in the ice bin 600. The driver 480 may further include a cam that rotates by the rotational power of the motor. The ice maker 200 may further include a sensor that senses the rotation of the cam.

For example, the cam is provided with a magnet, and the sensor may be a hall sensor detecting magnetism of the magnet during the rotation of the cam. The sensor may output first and second signals that are different outputs according to whether the sensor senses a magnet. One of the first signal and the second signal may be a high signal, and the other may be a low signal.

The controller 800 to be described later may determine a position of the second tray 380 based on the type and pattern of the signal outputted from the sensor. That is, since the second tray 380 and the cam rotate by the motor, the position of the second tray 380 may be indirectly determined based on a detection signal of the magnet provided in the cam.

For example, a water supply position, an ice making position, and an ice separation position, which will be described later, may be distinguished and determined based on the signals outputted from the sensor.

The ice maker 200 may further include a second pusher 540. The second pusher 540 may be installed, for example, on the bracket 220. The second pusher 540 may include at least one extension part 544. For example, the second pusher 540 may include an extension part 544 provided with the same number as the number of ice making cells 320*a*, but is not limited thereto. The extension part 544 may push out the ice disposed in the ice making cell 320*a*. For example, the extension part 544 may pass through the second tray case 400 to contact the second tray 380 defining the ice making cell 320*a* and then press the contacting second tray 380.

Therefore, the second tray case 400 may include a hole 422 through which a portion of the second pusher 540 passes.

The first tray case 300 may be rotatably coupled to the second tray case 400 with respect to the second tray case 400 and then be disposed to change in angle about the shaft 440.

In this embodiment, the second tray 380 may be made of a non-metal material. For example, when the second tray 380 is pressed by the second pusher 540, the second tray 380 may be made of a flexible or soft material which is deformable. Although not limited, the second tray 380 may be made of, for example, a silicon material.

Therefore, while the second tray 380 is deformed while the second tray 380 is pressed by the second pusher 540, pressing force of the second pusher 540 may be transmitted to ice. The ice and the second tray 380 may be separated from each other by the pressing force of the second pusher 540.

When the second tray 380 is made of the non-metal material and the flexible or soft material, the coupling force or attaching force between the ice and the second tray 380 may be reduced, and thus, the ice may be easily separated from the second tray 380.

Also, if the second tray 380 is made of the non-metallic material and the flexible or soft material, after the shape of the second tray 380 is deformed by the second pusher 540, when the pressing force of the second pusher 540 is removed, the second tray 380 may be easily restored to its original shape.

On the other hand, the first tray 320 may be made of a metal material. In this case, since the coupling force or the attaching force between the first tray 320 and the ice is strong, the ice maker 200 according to this embodiment may include at least one of the ice separation heater 290 or the first pusher 260. For another example, the first tray 320 may be made of a non-metallic material. When the first tray 320 is made of the non-metallic material, the ice maker 200 may include only one of the ice separation heater 290 and the first pusher 260. Alternatively, the ice maker 200 may not include the ice separation heater 290 and the first pusher 260. Although not limited, the first tray 320 may be made of, for example, a silicon material.

That is, the first tray 320 and the second tray 380 may be made of the same material. When the first tray 320 and the second tray 380 are made of the same material, the first tray 320 and the second tray 380 may have different hardness to maintain sealing performance at the contact portion between the first tray 320 and the second tray 380.

In this embodiment, since the second tray 380 is pressed by the second pusher 540 to be deformed, the second tray 380 may have hardness less than that of the first tray 320 to facilitate the deformation of the second tray 380.

Referring to FIG. 5, the ice maker 200 may further include a second temperature sensor 700 (or tray temperature sensor) to sense a temperature of the ice making cell 320*a*. The second temperature sensor 700 may sense a temperature of water or ice of the ice making cell 320*a*.

The second temperature sensor 700 may be disposed adjacent to the first tray 320 to sense the temperature of the first tray 320, thereby indirectly determining the water temperature or the ice temperature of the ice making cell 320*a*. In this embodiment, the water temperature or the ice temperature of the ice making cell 320*a* may be referred to as an internal temperature of the ice making cell 320*a*.

The second temperature sensor 700 may be installed in the first tray case 300. In this case, the second temperature sensor 700 may contact the first tray 320 or may be spaced apart from the first tray 320 by a predetermined distance. Alternatively, the second temperature sensor 700 may be installed on the first tray 320 to contact the first tray 320. Of course, in a case in which the second temperature sensor 700 is disposed to pass through the first tray 320, the second temperature sensor 700 may directly sense the temperature of the water or the temperature of ice of the ice making cell 320*a*.

Meanwhile, a portion of the ice separation heater 290 may be positioned higher than the second temperature sensor 700 and may be spaced apart from the second temperature sensor 700. An electric wire 701 connected to the second temperature sensor 700 may be guided above the first tray case 300.

Referring to FIG. 6, the ice maker 200 according to this embodiment may be designed so that the positions of the second tray 380 are different from each other at a water supply position and an ice making position.

For example, the second tray 380 may include a second cell wall 381 defining a second cell 320*c* of the ice making cells 320*a* and a peripheral wall 382 extending along an outer edge of the second cell wall 381.

The second cell wall 381 may include an upper surface 381*a*. In this specification, the upper surface 381*a* of the second cell wall 381 may be referred to as the upper surface 381*a* of the second tray 380. The upper surface 381*a* of the second cell wall 381 may be positioned lower than the upper end portion of the peripheral wall 382.

The first tray 320 may include a first cell wall 321*a* defining a first cell 320*b* of the ice making cells 320*a*. The first cell wall 321*a* may include a straight portion 321*b* and a curved portion 321*c*. The curved portion 321*c* may be formed in an arc shape having a center of the shaft 440 as a radius of curvature. Accordingly, the peripheral wall 382 may also include a straight portion and a curved portion corresponding to the straight portion 321*b* and the curved portion 321*c*.

The first cell wall 321*a* may include a lower surface 321*d*. In the present specification, the lower surface 321*d* of the first cell wall 321*a* may be referred to be the lower surface 321*d* of the first tray 320. The lower surface 321*d* of the first cell wall 321*a* may contact the upper surface 381*a* of the second cell wall 381.

For example, in the water supply position as illustrated in FIG. 6, at least a portion of the upper surface 381*a* of the second cell wall 381 and the lower surface 321*d* of the first cell wall 321*a* may be spaced apart from each other. In FIG. 6, as an example, it is illustrated that all the upper surface 381*a* of the second cell wall 381 and the lower surface 321*d* of the first cell wall 321*a* are spaced apart from each other. Accordingly, the upper surface 381*a* of the second cell wall 381 may be inclined to form a predetermined angle with the lower surface 321*d* of the first cell wall 321*a*.

Although not limited, at the water supply position, the lower surface 321*d* of the first cell wall 321*a* may be maintained to be substantially horizontal, and the upper surface 381*a* of the second cell wall 381 may be disposed to be inclined with respect to the lower surface 321*d* of the first cell wall 321*a* under the first cell wall 321*a*.

In the state illustrated in FIG. 6, the peripheral wall 382 may surround the first cell wall 321*a*. In addition, the upper end portion of the circumferential wall 382 may be positioned higher than the lower surface 321*d* of the first cell wall 321*a*.

Meanwhile, in the ice making position (see FIG. 11), the upper surface 381*a* of the second cell wall 381 may contact at least a portion of the lower surface 321*d* of the first cell wall 321*a*.

The angle between the upper surface 381*a* of the second tray 380 and the lower surface 321*d* of the first tray 320 at the ice making position is smaller than the angle between the upper surface 382*a* of the second tray 380 and the lower surface 321*d* of the first tray 320 at the water supply position. In the ice making position, the upper surface 381*a* of the second cell wall 381 may contact all the lower surface 321*d* of the first cell wall 321*a*. In the ice making position, an upper surface 381*a* of the second cell wall 381 and a lower surface 321*d* of the first cell wall 321*a* may be disposed to be substantially horizontal.

In this embodiment, the reason why the water supply position and the ice making position of the second tray 380 are different is that in a case in which the ice maker 200 includes a plurality of ice making cells 320*a*, water is to be uniformly distributed to the plurality of ice making cells 320*a* without forming a water passage for communication between respective ice making cells 320*a* in the first tray 320 and/or the second tray 380.

If the ice maker 200 includes the plurality of ice making cells 320*a* when a water passage is formed in the first tray 320 and/or the second tray 380, the water supplied to the ice maker 200 is distributed to the plurality of ice making cells 320*a* along the water passage.

However, in a state in which the water is distributed to the plurality of ice making cells 320*a*, water exists also in the water passage, and when ice is generated in this state, ice generated in the ice making cell 320*a* is connected by ice generated in the water passage portion.

In this case, there is a possibility that the ices will stick to each other even after the ice separation is completed, and even if the ice is separated from each other, some of the plurality of the ices contains ice generated in the water passage portion, so there is a problem that the shape of the ice is different from the shape of the ice in the ice making cell.

However, as in this embodiment, in a state in which the second tray 380 is spaced apart from the first tray 320 at the water supply position, the water dropped to the second tray 380 may be uniformly distributed to the plurality of second cells 320*c* of the second tray 380.

For example, the first tray 320 may include a communication hole 321*e*. In a case in which the first tray 320 includes one first cell 320*b*, the first tray 320 may include one communication hole 321*e*. When the first tray 320 includes a plurality of first cells 320*b*, the first tray 320 may include a plurality of communication holes 321*e*. The water supply part 240 may supply water to one communication hole 321*e* among the plurality of communication holes 321*e*. In this case, water supplied through the one communication hole 321*e* drops into the second tray 380 after passing through the first tray 320.

During the water supply process, water may drop into any one second cell 320*c* of the plurality of second cells 320*c* of the second tray 380. Water supplied to one second cell 320*c* overflows from one second cell 320*c*.

In this embodiment, since the upper surface 381*a* of the second tray 380 is spaced apart from the lower surface 321*d* of the first tray 320, the water overflowing from the one second cell 320*c* moves to another adjacent second cell 320*c* along the upper surface 381*a* of the second tray 380. Accordingly, water may be fully filled in the plurality of second cells 320*c* of the second tray 380.

In addition, in a state in which the water supply is completed, a portion of the water supplied can be fully filled in the second cell 320*c*, and another portion of the water supplied can be filled in the space between the first tray 320 and the second tray 380.

Figure 10:
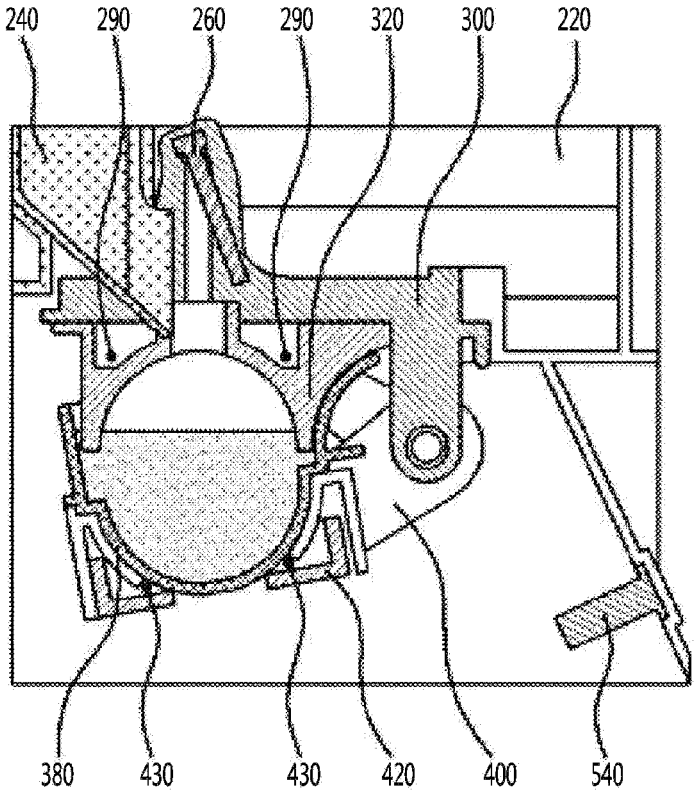
FIG. 10 is a view illustrating a state in which the water supply is completed at a water supply position.

In the water supply position, according to the volume of the ice making cell 320*a*, water, when water supply is completed may be positioned only in the space between the first tray 320 and the second tray 380 or may be positioned in the space between the first tray 320 and the second trays 380 and also in the first tray 320 (see FIG. 10).

When the second tray 380 moves from the water supply position to the ice making position, water in the space between the first tray 320 and the second tray 380 can be uniformly distributed to the plurality of first cells 320*b*.

Meanwhile, when a water passage is formed in the first tray 320 and/or the second tray 380, ice generated in the ice making cell 320*a* is also generated in the water passage portion.

In this case, in order to generate transparent ice, when the controller of the refrigerator controls so that at least one of the cooling power of the cold air supply part 900 and the heating amount of the transparent ice heater 430 are varied according to the mass per unit height of water in the ice making cell 320*a*, at least one of the cooling power of the cold air supply part 900 and the heating amount of the transparent ice heater 430 in the portion where the water passage is formed is controlled to be rapidly varied several times or more.

This is because the mass per unit height of water rapidly increases several times or more in the portion where the water passage is formed. In this case, reliability problems of parts may occur, and expensive parts in which width between the maximum output and minimum output is large can be used, which may be disadvantageous in terms of power consumption and cost of the parts. As a result, the present invention may require a technique related to the above-described ice making position to also generate transparent ice.

Figure 7:
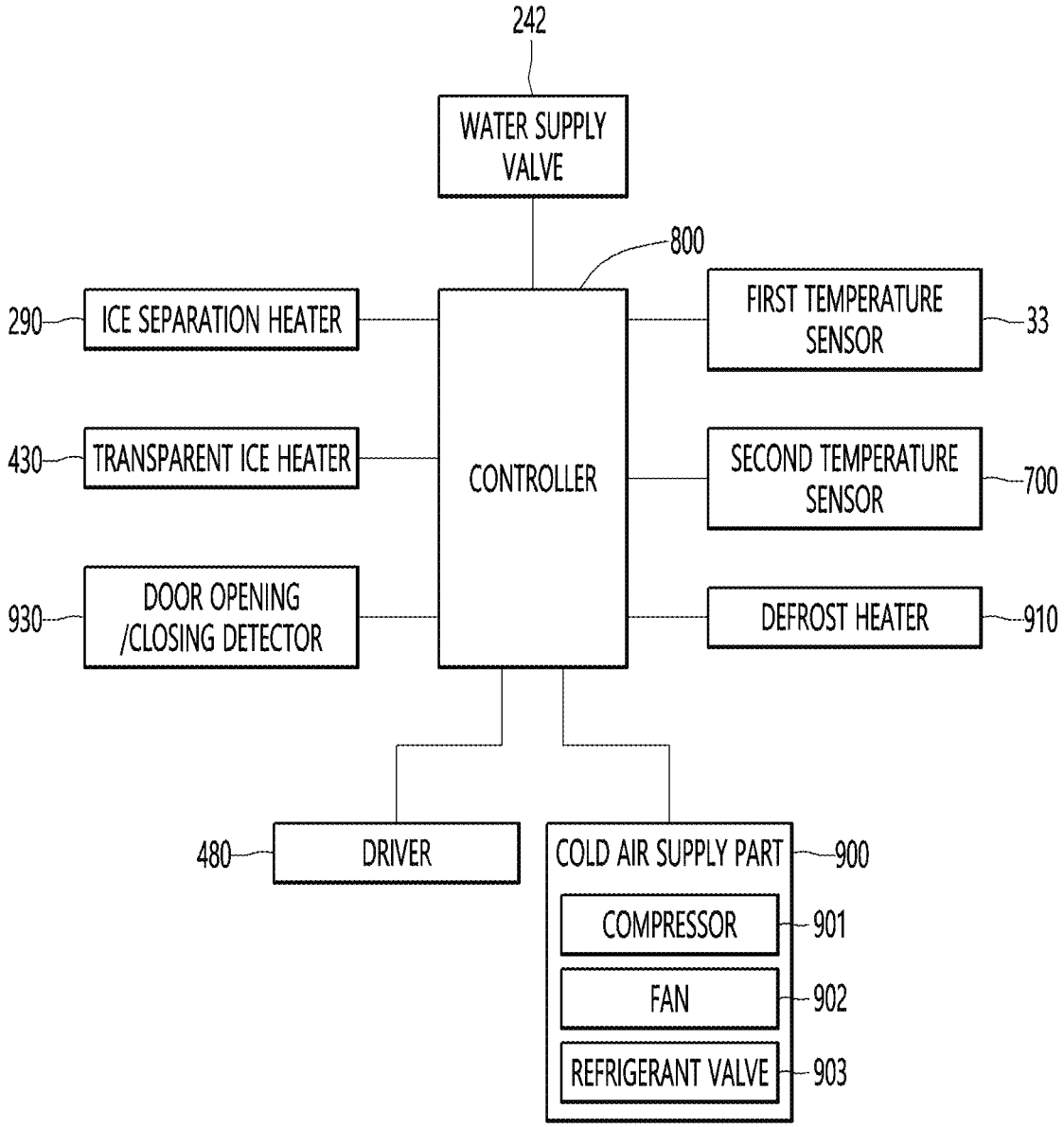
FIG. 7 is a block diagram illustrating a control of a refrigerator according to an embodiment.

FIG. 7 is a block diagram illustrating a control of a refrigerator according to an embodiment.

Referring to FIG. 7, the refrigerator according to this embodiment may include a cold air supply part 900 supplying cold air to the freezing compartment 32 (or the ice making cell). The cold air supply part 900 may supply cold air to the freezing compartment 32 using a refrigerant cycle.

For example, the cold air supply part 900 may include a compressor 901 compressing the refrigerant. The temperature of the cold air supplied to the freezing compartment 32 may vary according to the output (or frequency) of the compressor. Alternatively, the cold air supply part 900 may include a fan 902 blowing air to an evaporator. An amount of cold air supplied to the freezing compartment 32 may vary according to the output (or rotation rate) of the fan. Alternatively, the cold air supply part 900 may include a refrigerant valve 903 controlling the amount of refrigerant flowing through the refrigerant cycle. The amount of refrigerant flowing through the refrigerant cycle may vary by adjusting an opening degree by the refrigerant valve, and thus, the temperature of the cold air supplied to the freezing compartment 32 may vary. Therefore, in this embodiment, the cold air supply part 900 may include one or more of the compressor, the fan, and the refrigerant valve.

The refrigerator according to this embodiment may further include a controller 800 that controls the cold air supply part 900.

The refrigerator may further include a water supply valve 242 controlling the amount of water supplied through the water supply part 240. The refrigerator may further include a door opening/closing detector 930 for detecting opening/closing of a door of a storage chamber (for example, the freezing compartment 32) in which the ice maker 200 is installed.

The controller 800 may control a portion or all of the ice separation heater 290, the transparent ice heater 430, the driver 480, the cold air supply part 900, and the water supply valve 242.

In addition, when the door opening/closing detector 930 detects the opening/closing of the door (a state in which the door is open and closed), the controller 800 may determine whether the cooling power of the cold air supply part 900 is varied based on the temperature detected by the first temperature sensor 33.

In addition, when the door opening/closing detector 930 detects the opening/closing of the door, the controller 800 may determine whether the output of the transparent ice heater 430 is varied based on the temperature detected by the second temperature sensor 700.

In this embodiment, when the ice maker 200 includes both the ice separation heater 290 and the transparent ice heater 430, an output of the ice separation heater 290 and an output of the transparent ice heater 430 may be different from each other. When the outputs of the ice separation heater 290 and the transparent ice heater 430 are different from each other, an output terminal of the ice separation heater 290 and an output terminal of the transparent ice heater 430 may be provided in different shapes, incorrect connection of the two output terminals may be prevented.

Although not limited, the output of the ice separation heater 290 may be set larger than that of the transparent ice heater 430. Accordingly, ice may be quickly separated from the first tray 320 by the ice separation heater 290.

In this embodiment, when the ice separation heater 290 is not provided, the transparent ice heater 430 may be disposed at a position adjacent to the second tray 380 described above or be disposed at a position adjacent to the first tray 320.

The refrigerator may further include a first temperature sensor 33 (or an internal temperature sensor) that senses a temperature of the freezing compartment 32. The controller 800 may control the cold air supply part 900 based on the temperature sensed by the first temperature sensor 33. The controller 800 may determine whether ice making is completed based on the temperature sensed by the second temperature sensor 700.

Figure 8:
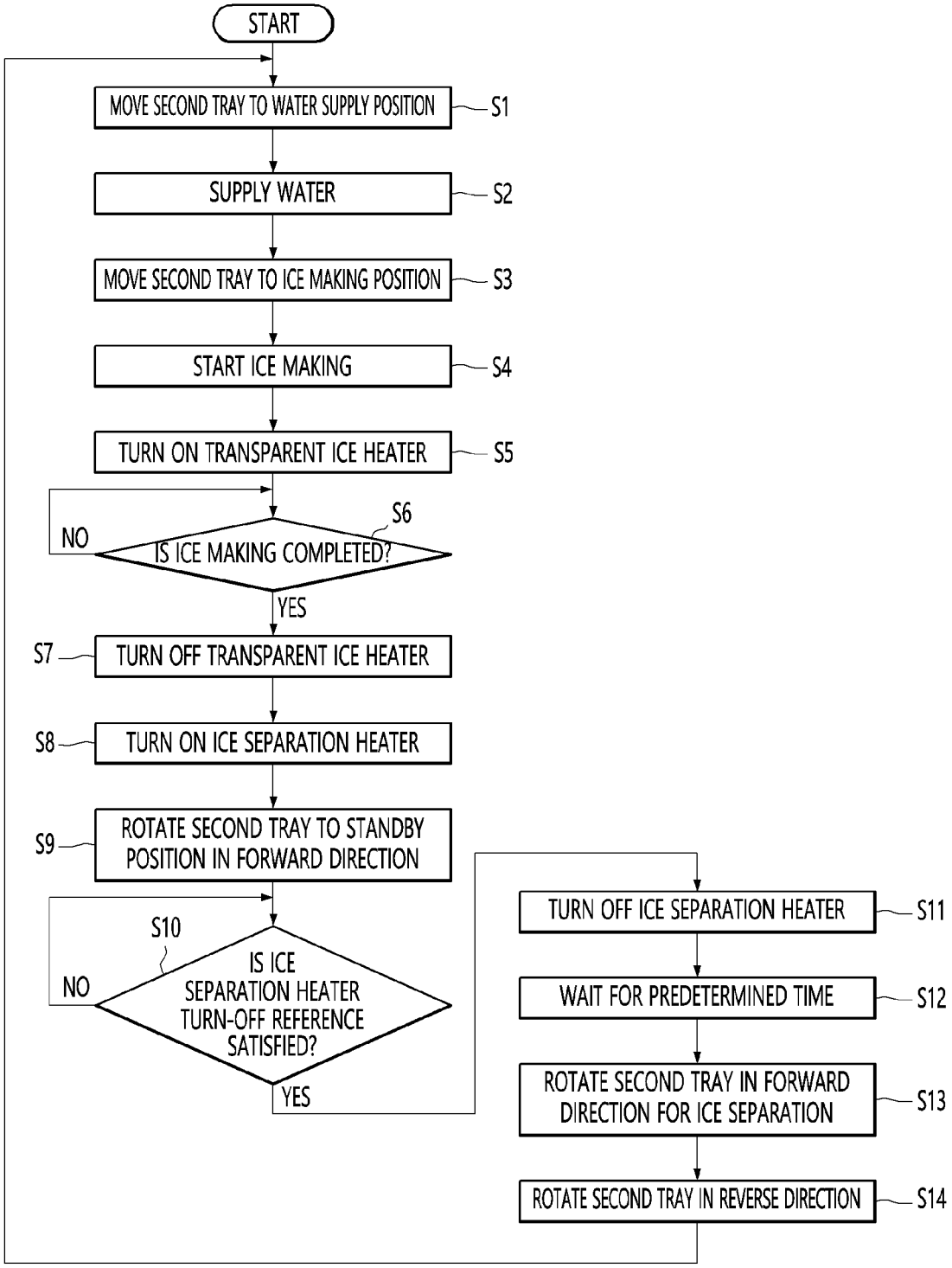
FIG. 8 is a flowchart for explaining a process of making ice in the ice maker according to an embodiment.
Figure 9:
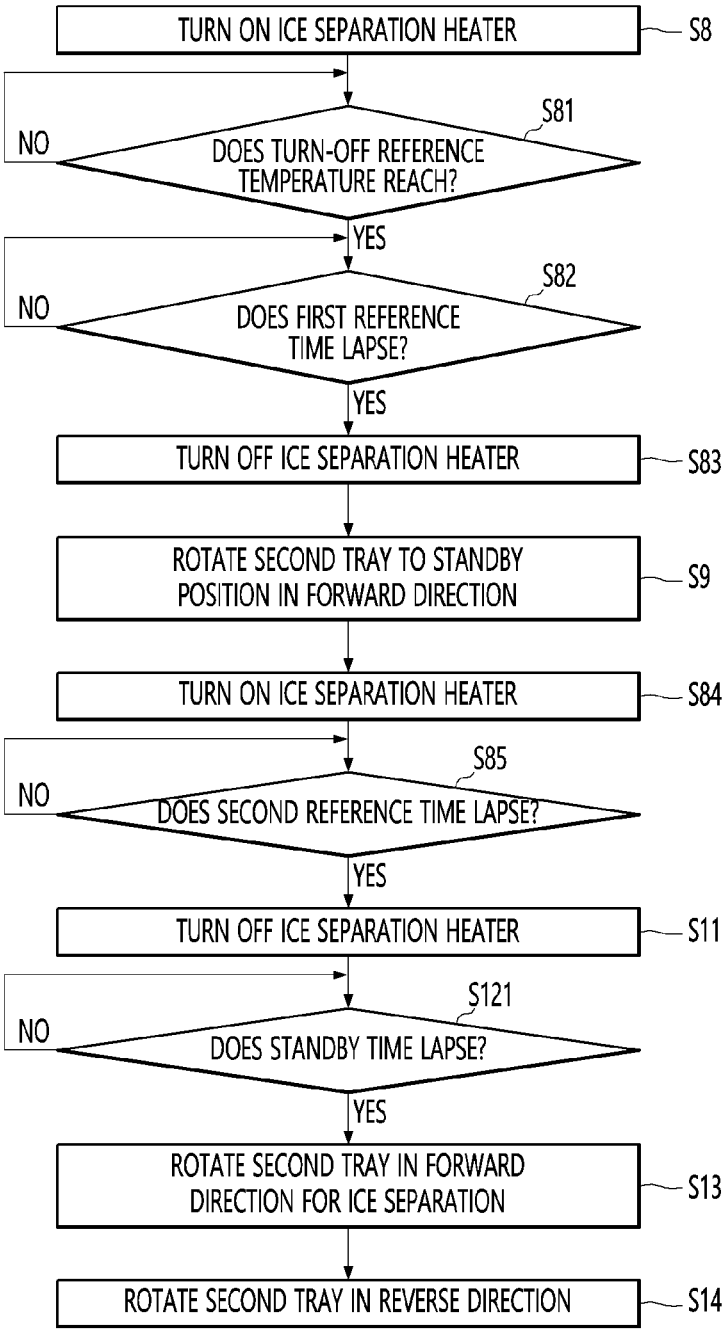
FIG. 9 is a flowchart illustrating a process in which ice is separated in an ice maker according to an embodiment of the present invention.

FIG. 8 is a flowchart for explaining a process of making ice in the ice maker according to an embodiment. FIG. 9 is a flowchart illustrating a process in which ice is separated in an ice maker according to an embodiment of the present invention.

Figure 11:
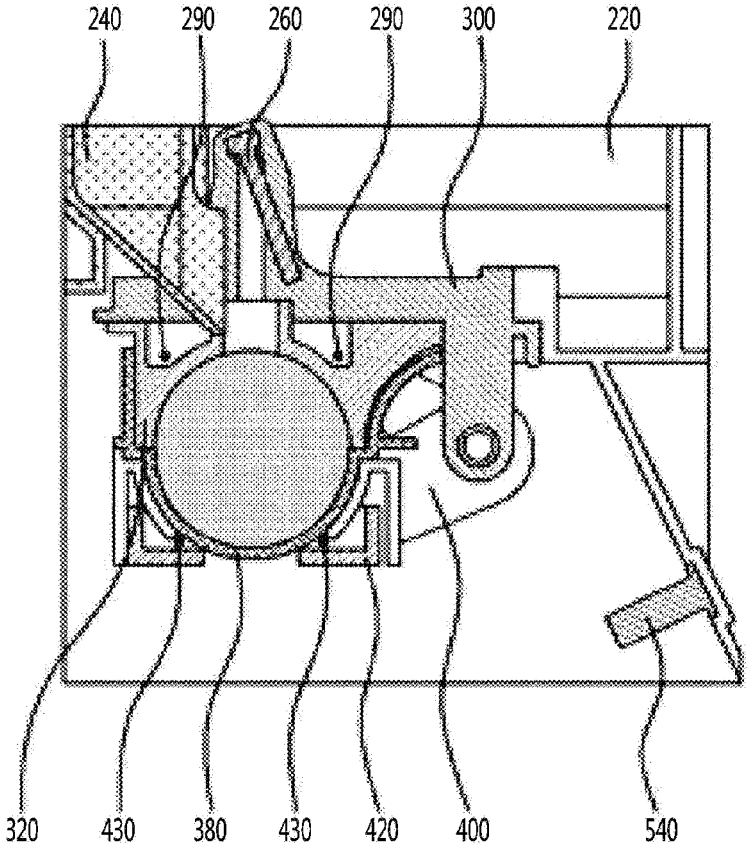
FIG. 11 is a view illustrating a state in which ice is generated at the ice making position.
Figure 12:
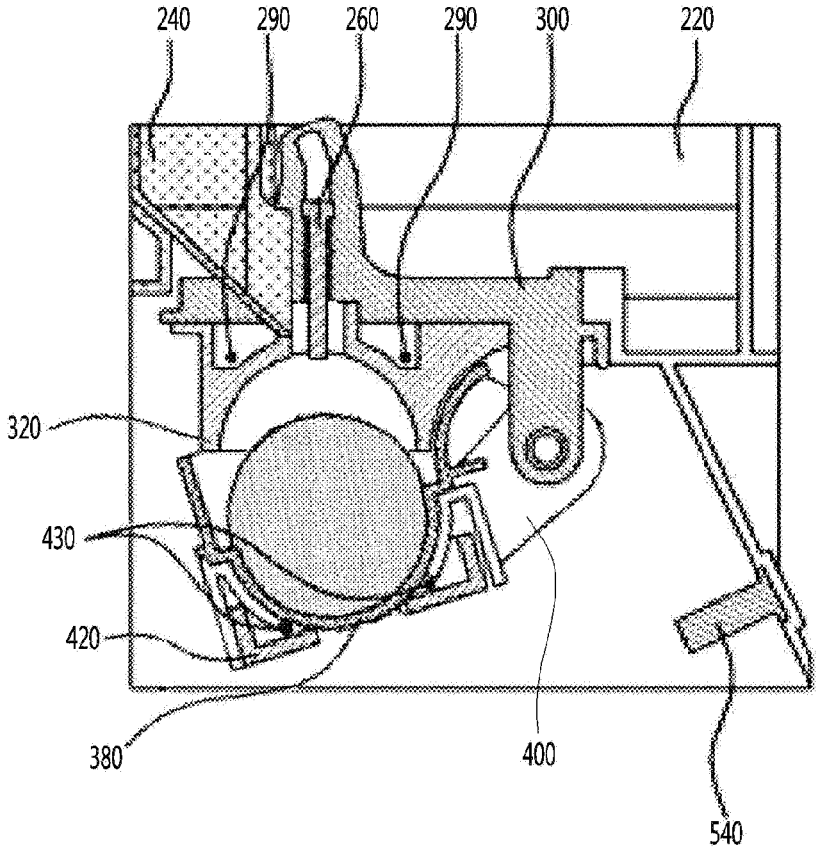
FIG. 12 is a view illustrating a state in which a second tray has been moved to a standby position during an ice separation process.
Figure 13:
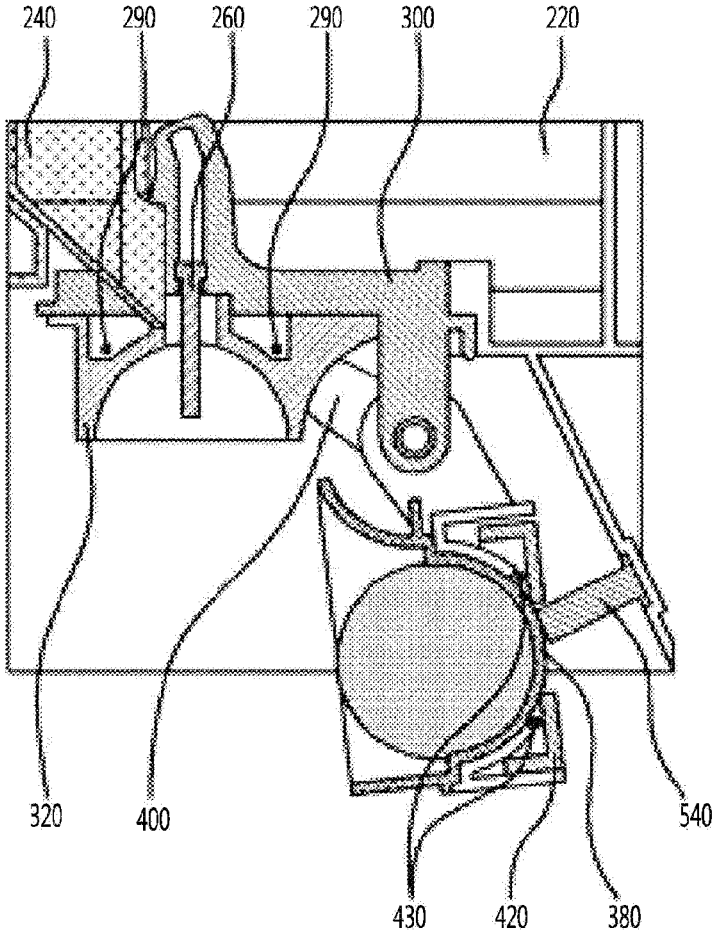
FIG. 13 is a view illustrating a state in which the second tray and the first tray are separated from each other during an ice separation process.
Figure 14:
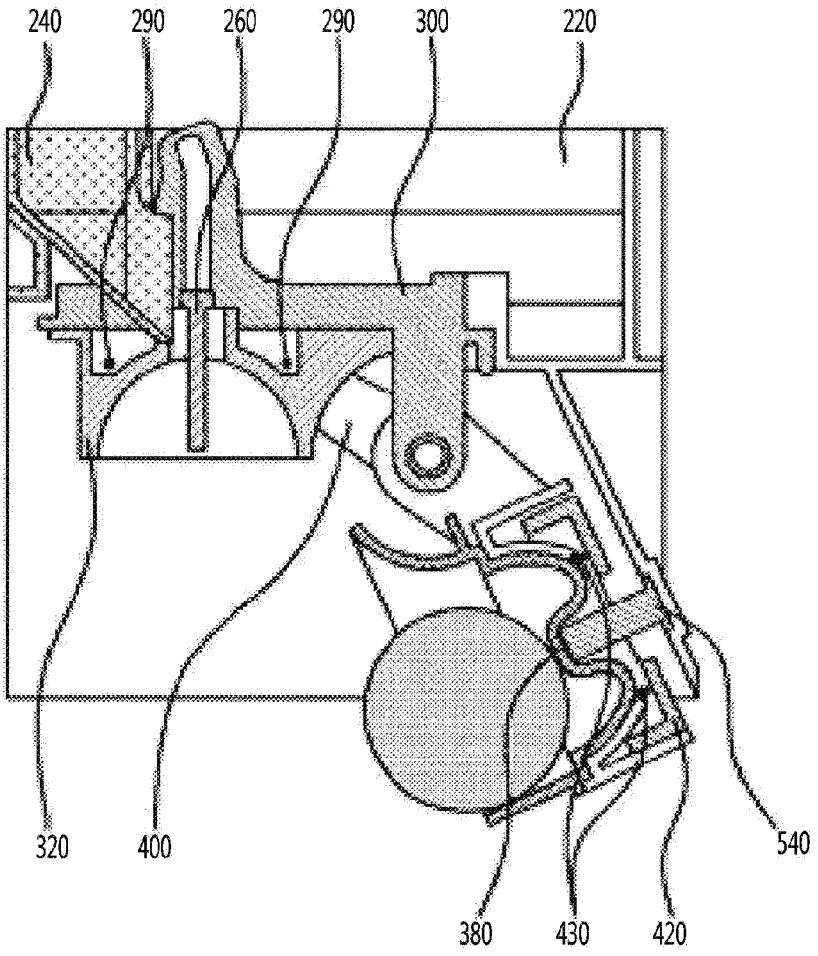
FIG. 14 is a view illustrating a state in which a second tray is moved to an ice separation position during an ice separation process.

FIG. 10 is a view illustrating a state in which water supply is completed at a water supply position, FIG. 11 is a view illustrating a state in which ice is generated at the ice making position, FIG. 12 is a view illustrating a state in which a second tray has been moved to a standby position during an ice separation process, FIG. 13 is a view illustrating a state in which the second tray and the first tray are separated from each other during an ice separation process, and FIG. 14 is a view illustrating a state in which a second tray is moved to an ice separation position during an ice separation process.

Referring to FIGS. 6 to 14, to make ice in the ice maker 200, the controller 800 moves the second tray 380 to a water supply position (S1).

In this specification, a direction in which the second tray 380 moves from the ice making position of FIG. 11 to the ice separation position of FIG. 14 may be referred to as forward movement (or forward rotation). On the other hand, the direction from the ice separation position of FIG. 14 to the water supply position of FIG. 6 may be referred to as reverse movement (or reverse rotation).

The movement to the water supply position of the second tray 380 is detected by a sensor, and when it is detected that the second tray 380 moves to the water supply position, the controller 800 stops the driver 480.

The water supply starts when the second tray 380 moves to the water supply position (S2). For the water supply, the controller 800 turns on the water supply valve 242, and when it is determined that a predetermined amount of water is supplied, the controller 800 may turn off the water supply valve 242.

For example, in the process of supplying water, when a pulse is outputted from a flow sensor (not shown), and the outputted pulse reaches a reference pulse, it may be determined that a predetermined amount of water is supplied.

After the water supply is completed, the controller 800 controls the driver 480 to allow the second tray 380 to move to the ice making position (S3). For example, the controller 800 may control the driver 480 to allow the second tray 380 to move from the water supply position in the reverse direction.

When the second tray 380 move in the reverse direction, the second contact surface 382*c* of the second tray 380 comes close to the upper surface 381*a* of the first tray 320. Then, water between the upper surface 381*a* of the second tray 380 and the lower surface 321*d* of the first tray 320 is divided into each of the plurality of second cells 320*c* and then is distributed. When the upper surface 381*a* of the second tray 380 and the lower surface 321*d* of the first tray 320 contact each other, water is filled in the first cell 321*a*.

The movement to the ice making position of the second tray 380 is detected by a sensor, and when it is detected that the second tray 380 moves to the ice making position, the controller 800 stops the driver 480.

In the state in which the second tray 380 moves to the ice making position, ice making is started (S4). The ice making may be started when the second tray 380 reaches the ice making position. Alternatively, when the second tray 380 reaches the ice making position, and the water supply time elapses, the ice making may be started.

When ice making is started, the controller 800 may control the cold air supply part 900 to supply cool air to the ice making cell 320*a*.

After the ice making is started, the controller 800 may control the transparent ice heater 430 to be turned on in at least partial sections of the cold air supply part 900 supplying the cold air to the ice making cell 320*a* (S5).

When the transparent ice heater 430 is turned on, since the heat of the transparent ice heater 430 is transferred to the ice making cell 320*a*, the ice making rate of the ice making cell 320*a* may be delayed.

According to this embodiment, the ice making rate may be delayed so that the bubbles dissolved in the water inside the ice making cell 320*a* move from the portion at which ice is made toward the liquid water by the heat of the transparent ice heater 430 to make the transparent ice in the ice maker 200.

In the ice making process, the controller 800 may determine whether the turn-on condition of the transparent ice heater 430 is satisfied. In this embodiment, the transparent ice heater 430 is not turned on immediately after the ice making is started, and the transparent ice heater 430 may be turned on only when the turn-on condition of the transparent ice heater 430 is satisfied.

Generally, the water supplied to the ice making cell 320*a* may be water having normal temperature or water having a temperature lower than the normal temperature. The temperature of the water supplied is higher than a freezing point of water. Thus, after the water supply, the temperature of the water is lowered by the cold air, and when the temperature of the water reaches the freezing point of the water, the water is changed into ice.

In this embodiment, the transparent ice heater 430 may not be turned on until the water is phase-changed into ice.

If the transparent ice heater 430 is turned on before the temperature of the water supplied to the ice making cell 320*a* reaches the freezing point, the speed at which the temperature of the water reaches the freezing point by the heat of the transparent ice heater 430 is slow. As a result, the starting of the ice making may be delayed.

The transparency of the ice may vary depending on the presence of the air bubbles in the portion at which ice is made after the ice making is started. If heat is supplied to the ice making cell 320*a* before the ice is made, the transparent ice heater 430 may operate regardless of the transparency of the ice.

Thus, according to this embodiment, after the turn-on condition of the transparent ice heater 430 is satisfied, when the transparent ice heater 430 is turned on, power consumption due to the unnecessary operation of the transparent ice heater 430 may be prevented.

Alternatively, even if the transparent ice heater 430 is turned on immediately after the start of ice making, since the transparency is not affected, it is also possible to turn on the transparent ice heater 430 after the start of the ice making.

In this embodiment, the controller 800 may determine that the turn-on condition of the transparent ice heater 430 is satisfied when a predetermined time elapses from the set specific time point. The specific time point may be set to at least one of the time points before the transparent ice heater 430 is turned on. For example, the specific time point may be set to a time point at which the cold air supply part 900 starts to supply cooling power for the ice making, a time point at which the second tray 380 reaches the ice making position, a time point at which the water supply is completed, and the like.

In this embodiment, the controller 800 determines that the turn-on condition of the transparent ice heater 430 is satisfied when a temperature sensed by the second temperature sensor 700 reaches a turn-on reference temperature.

For example, the turn-on reference temperature may be a temperature for determining that water starts to freeze at the uppermost side (side of the communication hole) of the ice making cell 320*a*.

When a portion of the water is frozen in the ice making cell 320*a*, the temperature of the ice in the ice making cell 320*a* is below zero. The temperature of the first tray 320 may be higher than the temperature of the ice in the ice making cell 320*a*.

Alternatively, although water is present in the ice making cell 320*a*, after the ice starts to be made in the ice making cell 320*a*, the temperature sensed by the second temperature sensor 700 may be below zero.

Thus, to determine that making of ice is started in the ice making cell 320*a* on the basis of the temperature detected by the second temperature sensor 700, the turn-on reference temperature may be set to the below-zero temperature.

That is, when the temperature sensed by the second temperature sensor 700 reaches the turn-on reference temperature, since the turn-on reference temperature is below zero, the ice temperature of the ice making cell 320*a* is below zero, i.e., lower than the below reference temperature. Therefore, it may be indirectly determined that ice is made in the ice making cell 320*a*.

As described above, when the transparent ice heater 430 is not used, the heat of the transparent ice heater 430 is transferred into the ice making cell 320*a*.

In this embodiment, when the second tray 380 is disposed below the first tray 320, the transparent ice heater 430 is disposed to supply the heat to the second tray 380, the ice may be made from an upper side of the ice making cell 320*a*.

In this embodiment, since ice is made from the upper side in the ice making cell 320*a*, the bubbles move downward from the portion at which the ice is made in the ice making cell 320*a* toward the liquid water.

Since density of water is greater than that of ice, water or bubbles may convex in the ice making cell 320*a*, and the bubbles may move to the transparent ice heater 430.

In this embodiment, the mass (or volume) per unit height of water in the ice making cell 320*a* may be the same or different according to the shape of the ice making cell 320*a*. For example, when the ice making cell 320*a* is a rectangular parallelepiped, the mass (or volume) per unit height of water in the ice making cell 320*a* is the same. On the other hand, when the ice making cell 320*a* has a shape such as a sphere, an inverted triangle, a crescent moon, etc., the mass (or volume) per unit height of water is different.

When the cooling power of the cold air supply part 900 is constant, if the heating amount of the transparent ice heater 430 is the same, since the mass per unit height of water in the ice making cell 320*a* is different, an ice making rate per unit height may be different.

For example, if the mass per unit height of water is small, the ice making rate is high, whereas if the mass per unit height of water is high, the ice making rate is slow.

As a result, the ice making rate per unit height of water is not constant, and thus, the transparency of the ice may vary according to the unit height. In particular, when ice is made at a high rate, the bubbles may not move from the ice to the water, and the ice may contain the bubbles to lower the transparency.

That is, the more the variation in ice making rate per unit height of water decreases, the more the variation in transparency per unit height of made ice may decrease.

Therefore, in this embodiment, the control part 800 may control the cooling power and/or the heating amount so that the cooling power of the cold air supply part 900 and/or the heating amount of the transparent ice heater 430 is variable according to the mass per unit height of the water of the ice making cell 320*a*.

In this specification, the variable of the cooling power of the cold air supply part 900 may include one or more of a variable output of the compressor, a variable output of the fan, and a variable opening degree of the refrigerant valve.

Also, in this specification, the variation in the heating amount of the transparent ice heater 430 may represent varying the output of the transparent ice heater 430 or varying the duty of the transparent ice heater 430.

In this case, the duty of the transparent ice heater 430 represents a ratio of the turn-on time and a sum of the turn-on time and the turn-off time of the transparent ice heater 430 in one cycle, or a ratio of the turn-off time and a sum of the turn-on time and the turn-off time of the transparent ice heater 430 in one cycle.

In this specification, a reference of the unit height of water in the ice making cell 320*a* may vary according to a relative position of the ice making cell 320*a* and the transparent ice heater 430.

If the ice making rate varies for the height, the transparency of the ice may vary for the height. In a specific section, the ice making rate may be too fast to contain bubbles, thereby lowering the transparency.

Therefore, in this embodiment, the output of the transparent ice heater 430 may be controlled so that the ice making rate for each unit height is the same or similar while the bubbles move from the portion at which ice is made to the water in the ice making process.

The output of the transparent ice heater 430 is gradually reduced from the first section to the intermediate section after the transparent ice heater 430 is initially turned on.

The output of the transparent ice heater 430 may be minimum in the intermediate section in which the mass of unit height of water is minimum. The output of the transparent ice heater 430 may again increase step by step from the next section of the intermediate section.

The transparency of the ice may be uniform for each unit height, and the bubbles may be collected in the lowermost section by the output control of the transparent ice heater 430. Thus, when viewed on the ice as a whole, the bubbles may be collected in the localized portion, and the remaining portion may become totally transparent.

Even if the ice making cell 320*a* does not have the spherical shape, the transparent ice may be made when the output of the transparent ice heater 430 varies according to the mass for each unit height of water in the ice making cell 320*a*.

The heating amount of the transparent ice heater 430 when the mass for each unit height of water is large may be less than that of the transparent ice heater 430 when the mass for each unit height of water is small.

For example, while maintaining the same cooling power of the cold air supply part 900, the heating amount of the transparent ice heater 430 may vary so as to be inversely proportional to the mass per unit height of water.

Also, it is possible to make the transparent ice by varying the cooling power of the cold air supply part 900 according to the mass per unit height of water.

For example, when the mass per unit height of water is large, the cold force of the cold air supply part 900 may increase, and when the mass per unit height is small, the cold force of the cold air supply part 900 may decrease.

For example, while maintaining a constant heating amount of the transparent ice heater 430, the cooling power of the cold air supply part 900 may vary to be proportional to the mass per unit height of water.

Referring to the variable cooling power pattern of the cold air supply part 900 in the case of making the spherical ice, the cooling power of the cold air supply part 900 from the initial section to the intermediate section during the ice making process may gradually increase.

The cooling power of the cold air supply part 900 may be maximum in the intermediate section in which the mass for each unit height of water is minimum. The cooling power of the cold air supply part 900 may be reduced again from the next section of the intermediate section. Alternatively, the transparent ice may be made by varying the cooling power of the cold air supply part 900 and the heating amount of the transparent ice heater 430 according to the mass for each unit height of water.

For example, the heating power of the transparent ice heater 430 may vary so that the cooling power of the cold air supply part 900 is proportional to the mass per unit height of water and inversely proportional to the mass for each unit height of water.

According to this embodiment, when one or more of the cooling power of the cold air supply part 900 and the heating amount of the transparent ice heater 430 are controlled according to the mass per unit height of water, the ice making rate per unit height of water may be substantially the same or may be maintained within a predetermined range.

The controller 800 may determine whether the ice making is completed based on the temperature sensed by the second temperature sensor 700 (S6). When it is determined that the ice making is completed, the controller 800 may turn off the transparent ice heater 430 (S7).

For example, when the temperature sensed by the second temperature sensor 700 reaches a first reference temperature, the controller 800 may determine that the ice making is completed to turn off the transparent ice heater 430.

In this case, since a distance between the second temperature sensor 700 and each ice making cell 320*a* is different, in order to determine that the ice making is completed in all the ice making cells 320*a*, the controller 800 may perform the ice separation after a certain amount of time, at which it is determined that ice making is completed, has passed or when the temperature sensed by the second temperature sensor 700 reaches a second reference temperature lower than the first reference temperature.

When the ice making is completed, the controller 800 operates the ice separation heater 290 for ice separation (S8). When the ice separation heater 290 is turned on, heat from the heater is transferred to the first tray 320 so that ice may be separated from the surface (inner surface) of the first tray 320.

In addition, the heat of the ice separation heater 290 is transferred from the first tray 320 to the contact surface of the second tray 380, so that the lower surface 321*d* of the first tray 320 and the upper surface 381*a* of the second tray 380 are in a state of being capable of being separated.

However, when the heat transfer amount between the cold air in the freezing compartment 32 and the water in the ice making cell 320*a* is varied, if the heating amount of the ice separation heater 290 is not adjusted to reflect this, there is a problem that ice separation is not smooth since the ice excessively melt or ice does not melt enough.

In this embodiment, a case in which the heat transfer amount of cold air and water increases may be, for example, a case in which the cooling power of the cold air supply part 900 increases, or a case in which air having a temperature lower than the temperature of the cold air in the freezing compartment 32 is supplied to the freezing compartment 32.

On the other hand, a case in which the heat transfer amount of cold air and water is reduced may be, for example, a case in which the cooling power of the cold air supply part 900 is reduced, a case in which the door is opened and air having a temperature higher than the temperature of the cold air in the freezing compartment 32 is supplied to the freezing compartment 32, a case in which food having a temperature higher than the temperature of cold air in the freezing compartment 32 is put into the freezing compartment 32, or a state in which a defrost heater 910 for defrosting the evaporator is turned on.

For example, in a case in which the target temperature of the freezing compartment 32 decreases, the operating mode of the freezing compartment 32 is changed from the normal mode to the rapid cooling mode, the output of at least one of the compressor and the fan increases, or the opening degree of the refrigerant valve increases, the cooling power of the cold air supply part 900 may increases.

On the other hand, in a case in which the target temperature of the freezing compartment 32 increases, the operating mode of the freezing compartment 32 is changed from the rapid cooling mode to the normal mode, the output of at least one of the compressor and the fan is reduced, or the opening degree of the refrigerant valve is reduced, the cooling power of the cold air supply part 900 may be reduced.

In a case in which the heat transfer amount of the cold air and water increases, the temperature of the cold air around the ice maker 200 decreases, so that the rate of ice generation increases.

On the other hand, when the heat transfer amount of the cold air and water is reduced, the temperature of the cold air around the ice maker 200 increases, so that the rate of ice generation is slowed, and the ice making time is lengthened.

Accordingly, in this embodiment, in a case in which the heat transfer amount of cold air and water increases, the heating amount of the ice separation heater 290 may be controlled to increase. On the other hand, in a case in which the heat transfer amount of the cold air and water is reduced, the heating amount of the ice separation heater 290 may be controlled to be reduced.

As another example, it goes without saying that the ice separation heater 290 may transfer heat to the first tray 320 with constant output.

In this case, the controller 800 may determine the output of the ice separation heater 290 in consideration of an initial condition in order to solve a problem in which ice separation is not smooth due to external factors.

The initial condition may include a cooling power of the cold air supply part 900, a target temperature of the storage chamber, a door opening time, and a turn-on time of the defrost heater.

In detail, if the cooling power of the cold air supply part 900 is higher when the cooling power of the cold air supply part 900 is the second cooling power than when the cooling power thereof is the first cooling power during the ice making process, the controller can control the heating amount of the ice separation heater 290 to be larger when the cooling power of the cold air supply part 900 is the second cooling power than when the cooling power thereof is the first cooling power.

The high cooling power of the cold air supply part 900 means that the heat transfer amount of cold air and water increases, so as to prevent the case where the ice is not separated due to insufficient heating amount of the ice separation heater 290 if the cooling power of the cold air supply part 900 is high, the heating amount of the ice separation heater 290 may be controlled to be larger.

In addition, if the target temperature of the storage chamber set by the user is higher in the second temperature than in the first temperature, the controller 800 can control so that the heating amount of the ice separation heater 290, when the target temperature is the second temperature is smaller.

This is to prevent the case in which the target temperature of the storage chamber is set higher so that the ice excessively melts by the ice separation heater 290.

In addition, according to a similar principle, if the door opening time in the ice making process or the turn-on time of the defrost heater operating for defrosting is longer in the second time than in the first time, the controller 800 can control so that the heating amount of the ice separation heater 290 is smaller when the door opening time in the ice making process or the turn-on time of the defrost heater operating for defrosting is the second time.

After the ice separation heater 290 is turned on when the moving condition of the second tray 380 is satisfied, the controller 800 can rotate the second tray 380 in the forward direction so that the second tray 380 is moved to a standby position (or an additional heating position) in the forward direction (S9).

The moving condition of the second tray 380 may be determined based on at least one of the turn-on times of the ice separation heater 290 and a temperature sensed by the second temperature sensor 700.

As illustrated in FIG. 12, when the second tray 380 is moved in the forward direction, the second tray 380 is spaced apart from the first tray 320.

As an example, as illustrated in FIG. 12, the standby position may be a state in which the second tray 380 is moved further in the forward direction than the water supply position, and the second tray 380 is moved further in the reverse direction than the ice separation position. That is, the additional heating position may be between the water supply position and the ice separation position.

In detail, the angle between the lower surface 321*d* of the first tray 320 and the upper surface 381*a* of the second tray 380 at the additional heating position may be referred to as a first angle, and the first angle may be 15 degrees to 65 degrees.

In this embodiment, before the second tray 380 rotates in the forward direction, ice may be separated from the surface of the first tray 320 by the heat of the turned-on ice separation heater 290.

In this case, the ice may move together with the second tray 380 in a state of being supported by the second tray 380.

As another example, even if the heat of the ice separation heater 290 is applied to the first tray 320, there may be a case where ice is not separated from the surface of the first tray 320.

That is, when the second tray 380 is moved to the additional heating position, ice may be in a state of being settled on the second tray 380 in a cell separated from the first tray 320 among the plurality of ice making cells 320*a* and in the remaining cells, ice may be in a state of being attached to the first tray 320.

After the second tray 380 is rotated in the forward direction to the standby position, it is determined whether the turn-off reference of the ice separation heater 290 is satisfied (S10).

The turn-off reference of the ice separation heater 290 may be determined based on at least one of the turn-on times of the ice separation heater 290 and a temperature sensed by the second temperature sensor 700.

When the off reference of the ice separation heater 290 is satisfied, the controller 800 turns off the ice separation heater 290 (S11).

After the ice separation heater 290 is turned on, until the ice separation heater 290 is turned off, the ice separation heater 290 may maintain a turn-on state when the second tray 380 moves to the standby position.

Another example after the ice separation heater 290 is turned on, until the ice separation heater 290 is turned off and then the second tray 380 moves to the ice separation position will be described with reference to FIG. 9.

After the ice making heater 290 first transfers heat from the ice making position to the ice making cell 320*a* and is turned off, the second tray 380 is moved to the standby position, and the ice separation heater 290 may be turned on at the standby position again.

That is, when the moving condition of the second tray 380 is satisfied, the controller 800 may turn off the ice separation heater 290, and when the second tray 380 is moved to the standby position, the controller 800 may turn on the ice separation heater 290 again.

The moving condition of the second tray 380 for turning off the ice separation heater 290 may be a case in which the temperature sensed by the second temperature sensor 700 reaches the turn-off reference temperature (or first turn-off reference temperature) or more of the ice separation heater 290 or (S81), or a case of being operated during the turn-off reference time (S82). The turn-off reference time may be referred to as a first reference time.

In addition, in a case in which the temperature sensed by the second temperature sensor 700 reaches the first turn-off reference temperature during the turn-off reference time, the ice separation heater 290 may be turned off.

As an example, when the temperature sensed by the second temperature sensor 700 reaches the first turn-off reference temperature during a sufficient turn-off reference time to allow all ice to be separated in the plurality of ice making cells 320*a*, it may be determined that the moving condition of the tray 380 is satisfied.

However, in this case, some of the plurality of ice making cells 320*a* may excessively melt, and thus melting water may drop into the ice bin 600.

Accordingly, as another example, a turn-off reference time or a first turn-off reference temperature at which only some of the plurality of ice making cells 320*a* are separated may be set.

That is, the first turn-off reference temperature may be a temperature at which it is determined that ice in some ice making cells 320*a* among the plurality of ice making cells 320*a* can be separated, and the turn-off reference time may be a time at which it is determined that ice in some ice making cells 320*a* among the plurality of ice making cells 320*a* can be separated.

Although not limited, the first turn-off reference temperature may be set as the above-zero temperature. Alternatively, the first turn-off reference temperature may be set to a temperature higher than the first reference temperature.

When the movement condition of the second tray 380 is satisfied, the controller 800 turns off the ice separation heater 290 (S83).

After the ice separation heater 290 is turned off, the second tray 380 may be moved to the standby position (S9).

The controller 800 may turn on the ice separation heater 290 again for additional heating for separating ice attached to the first tray 320 (S84).

In detail, even after the second tray 380 is moved to the additional heating position, since some of the ice making cells 320*a* are attached to the first tray 320 and remain in a state of not melting, the controller 800 may operate the ice separation heater 290.

By additionally operating the ice separation heater 290, the load applied to the first pusher 260 may be reduced, thereby preventing the first pusher 260 from being damaged.

After the ice separation heater 290 is operated, when the second reference time elapses, the ice separation heater 290 may be turned off (S85, S11).

The second reference time may be a time sufficient to melt ice attached to the first tray 320 and not settled in the second tray 380 among the plurality of ice making cells 320*a*.

In addition, since ice attached to the first tray 320 may be easily separated from the first tray 320 due to the influence of gravity, the second reference time may be shorter than the first reference time. For example, the second reference time may be about 30 seconds.

After the ice separation heater 290 is turned off, the ice separation heater 290 may wait for a predetermined time so that the melting water by the ice separation heater 290 is cooled (S12).

When the water melting due to the heat of the ice separation heater 290 drops into the ice bin 600, a mat of ice cubes may be generated inside the ice bin 600, or the shape of the ice may be deformed due to the melting water. In order to prevent such a problem, after waiting for a predetermined time to cool the melting water, ice may be separated into the ice bin 600.

The controller 800 may make the second tray 320 wait for a predetermined time (or waiting time) (S121). The waiting time may be a time sufficient for the melting water to cool and is preferably longer than the second reference time.

As an example, in a state in which the second tray 320 is in the additional heating position, the second tray 320 may wait for a predetermined time.

As another example, after the ice separation heater 290 additionally transfers heat to the second tray 320, the controller 800 may also make the second tray 320 wait for a predetermined time at the specific position in which the second tray 320 is further moved in a forward direction. The specific position may be between the standby position and the ice separation position.

Through this, the ice inside the ice making cell 320*a* may not be separated into the ice bin 600 and cold air may be easily introduced into the ice making cell 320*a*.

When the waiting time has elapsed, the controller 800 may rotate the second tray 380 in a forward direction to move the second tray 380 to the ice separation position (S13).

Meanwhile, the moving force of the second tray 380 is transmitted to the first pusher 260 by the pusher link 500. Then, the first pusher 260 descends along the guide slot 302, so that the extension part 264 passes through the communication hole 321*e* and presses the ice in the ice making cell 320*a*.

In this embodiment, in the ice separation process, the ice may be separated from the first tray 320 before the extension part 264 presses the ice. That is, ice may be separated from the surface of the first tray 320 by the heat of the ice separation heater 290. In this case, the ice may move together with the second tray 380 in a state of being supported by the second tray 380.

As another example, there may a case in which ice may not be separated from the surface of the first tray 320 even by the first and second heating of the ice separation heater 290.

Accordingly, when the second tray 380 moves in the forward direction, there is a possibility that ice may be separated from the second tray 380 in a state in which the ice is in close contact with the first tray 320.

In this state, in the process of moving the second tray 380, the extension part 264 passing through the communication hole 321*e* presses the ice in close contact with the first tray 320, so that the ice may be separated from the first tray 320. Ice separated from the first tray 320 may be supported by the second tray 380.

In a case in which ice moves together with the second tray 380 in a state of being supported by the second tray 380, the ice can be separated from the second tray 380 by the own weight thereof even if no external force is applied to the second tray 380.

In the process of moving the second tray 380, even if ice does not fall from the second tray 380 due to the own weight thereof, when the second tray 380 is pressed by the second pusher 540 as illustrated in FIG. 13, ice may be separated from the second tray 380 and fall downward.

Specifically, as illustrated in FIG. 13, in a process in which the second tray 380 moves, the second tray 380 contacts the extension part 544 of the second pusher 540.

When the second tray 380 continuously moves in the forward direction, the extension part 544 presses the second tray 380 to deform the second tray 380, and the pressing force of the extension part 544 is transmitted to the ice so that the ice may be separated from the surface of the second tray 380. Ice separated from the surface of the second tray 380 may fall down and be stored in the ice bin 600.

In this embodiment, as illustrated in FIG. 14, a position in which the second tray 380 is deformed by being pressed by the second pusher 540 may be referred to as an ice separation position.

In this embodiment, ice may be separated from the tray through two heating processes of the ice separation heater 290 and the first and second pushers in order to secure ice separation reliability of ice.

Whether the ice bin 600 is full may be detected while the second tray 380 moves from the ice making position to the ice separation position For example, the full ice detection lever 520 rotates together with the second tray 380, and the rotation of the full ice detection lever 520 is interrupted by ice while the full ice detection lever 520 rotates. In this case, it may be determined that the ice bin 600 is in a full ice state. On the other hand, if the rotation of the full ice detection lever 520 does not interfere with the ice while the full ice detection lever 520 rotates, it may be determined that the ice bin 600 is not in the ice state.

After the ice is separated from the second tray 380, the controller 800 controls the driver 480 to allow the second tray assembly 211 to move in the reverse direction (S14). Then, the second tray assembly 211 moves from the ice separation position to the water supply position.

When the second tray assembly 211 moves to the water supply position of FIG. 6, the controller 800 stops the driver 480 (S1).

When the second tray 380 is spaced apart from the extension part 544 while the second tray 380 moves in the reverse direction, the deformed second tray 380 may be restored to its original shape.

In the reverse movement of the second tray 380, the moving force of the second tray 380 is transmitted to the first pusher 260 by the pusher link 500, and thus, the first pusher 260 ascends, and the extension part 264 is removed from the ice making cell 320*a*.

Meanwhile, in this embodiment, the cooling power of the cold air supply part 900 may be determined in correspondence with the target temperature of the freezing compartment 32. The cold air generated by the cold air supply part 900 may be supplied to the freezing compartment 32.

Water in the ice making cell 320*a* may be phase-changed into ice by heat transfer of the cold air supplied to the freezing compartment 32 and the water in the ice making cell 320*a*.

In this embodiment, the heating amount of the transparent ice heater 430 for each unit height of water may be determined in consideration of a predetermined cooling power of the cold air supply part 900.

The heating amount (or output) of the transparent ice heater 430 determined in consideration of the predetermined cooling power of the cold air supply part 900 is referred to as a reference heating amount (or reference output). The size of the reference heating amount per unit height of the water is different.

However, when the heat transfer amount between the cold air of the freezing compartment 32 and the water in the ice making cell 320*a* is varied, if the heating amount of the transparent ice heater 430 is not adjusted to reflect this, there is a problem that the transparency of ice for each unit height is changed.

In this embodiment, a case in which the heat transfer amount of cold air and water increases may be a case in which, for example, the cooling power of the cold air supply part 900 increases, or a case in which air having a temperature lower than the temperature of the cold air in the freezing compartment 32 is supplied to the freezing compartment 32.

On the other hand, a case in which the heat transfer amount of cold air and water is reduced may be a case in which, for example, the cooling power of the cold air supply part 900 is reduced, a case in which the door is opened and air having the temperature which is higher than the temperature of the cold air in the freezing compartment 32 is supplied to the freezing compartment 32, a case in which food having a temperature higher than the temperature of cold air in the freezing compartment 32 is put into the freezing compartment 32, or a case in which a defrost heater (not illustrated) for defrosting the evaporator is turned on.

For example, in a case in which the target temperature of the freezing compartment 32 is lowered, the operating mode of the freezing compartment 32 is changed from the normal mode to the rapid cooling mode, the output of at least one of the compressor and the fan increases, or the opening degree of the refrigerant valve increases, the cooling power of the cold air supply part 900 may increases.

On the other hand, the target temperature of the freezing compartment 32 increases, the operating mode of the freezing compartment 32 is changed from the rapid cooling mode to the normal mode, the output of at least one of the compressor and the fan is reduced, or the opening degree of the refrigerant valve is reduced, the cooling power of the cold air supply part 900 may be reduced.

In a case in which the heat transfer amount of the cold air and water increases, the temperature of the cold air around the ice maker 200 decreases, thereby increasing the rate of ice generation.

On the other hand, when the heat transfer amount of the cold air and water is reduced, the temperature of the cold air around the ice maker 200 increases, so that the rate of ice generation is slowed, and the ice making time is lengthened.

Therefore, in this embodiment, in a case in which the heat transfer amount of cold air and water increases so that the ice making speed can be maintained within a predetermined range lower than the ice making speed when ice making is performed while the transparent ice heater 430 is turned off, the heating amount of the transparent ice heater 430 may be controlled to increase.

On the other hand, in a case where the heat transfer amount of the cold air and water is reduced, the heating amount of the transparent ice heater 430 may be controlled to be reduced.

In this embodiment, when the ice making speed is maintained within the predetermined range, the ice making speed becomes slower than the speed at which the bubbles move in the ice-generating portion from the ice making cell 320*a* so that no bubbles exist in the ice-generating portion.

What is claimed is:

1. An ice maker comprising:

a cell in which a liquid is phase-changed into ice;

a first tray configured to form at least a portion of a wall for providing the cell;

a second tray configured to form at least another portion of the wall for providing the cell;

a first heater to transfer heat to the first tray so that the ice is separated from a surface of the first tray; and a second heater to be controlled so that heat is supplied to the cell in at least partial sections while the cell is cooled to make a transparent ice, wherein the ice is separated from the first tray through at least two heating processes of the first heater, wherein the at least two heating processes of the first heater comprise:

a first heating process performed by operating the first heater, and a second heating process performed by operating the first heater and performed after the first heating process, and wherein a heating amount of the first heater in at least one period of an ice separation process differs from a heating amount of the second heater in at least one period of an ice making process.

2. The ice maker of claim 1, wherein the first heater is capable of being turned on for the first heating process after the ice making process is performed, and then the first heater is capable of being turned off after the first heater supplies the heat to the cell.

3. The ice maker of claim 1, wherein the first heater is capable of being turned on after the second heater is turned off, and then the first heater is capable of being turned off after the first heater provides the heat to the cell.

4. The ice maker of claim 1, wherein the first heater is capable of being turned on again for the second heating process after the first heater is turned off.

5. The ice maker of claim 1, wherein in a state in which the first tray is in contact with the second tray, the first heating process is performed, wherein after the second heating process is ended, the second tray moves toward an ice separation position, and wherein after the second tray is moved to the ice separation position, the second tray moves toward a liquid supply position.

6. The ice maker of claim 1, further comprising a first tray case coupled to the first tray, and a heater case at which the first heater is installed, wherein the heater case is integrally formed with the first tray case.

7. The ice maker of claim 6, further comprising a first tray cover coupled to the first tray, wherein the first tray cover has an opening formed to correspond to a shape of the cell of the first tray.

8. A refrigerator comprising:

a cabinet including a storage chamber;

a door that opens and closes the storage chamber; and the ice maker of claim 1.

9. An ice maker comprising:

a cell in which a liquid is phase-changed into ice;

a first tray configured to form at least a portion of a wall for providing the cell;

a second tray configured to form at least another portion of the wall for providing the cell; and a first heater to transfer heat to the first tray so that the ice is separated from a surface of the first tray, wherein the first heater is capable of being turned on for ice separation after ice making is performed, wherein it is determined whether a first turn-off reference of the first heater is satisfied after the first heater is turned on, wherein the first heater is capable of being turned off when the first turn-off reference of the first heater is satisfied, wherein the second tray is capable of being moved, wherein the first heater is capable of being turned on again for additional heating for separating the ice attached to the first tray after the first heater is turned off and the second tray is moved, and wherein the first heater is capable of being turned off again when a second turn-off reference of the first heater is satisfied after the first heater is turned on again.

10. The ice maker of claim 9, wherein it is determined whether the first turn-off reference of the first heater is satisfied based on a temperature sensed by a temperature sensor, and wherein it is determined whether the second turn-off reference of the first heater is satisfied based on a reference time.

11. The ice maker of claim 9, wherein after the first heater is turned off again, the second tray moves toward an ice separation position, and wherein after the second tray is moved to the ice separation position, the second tray moves toward a liquid supply position.

12. The ice maker of claim 9, further comprising a first tray case coupled to the first tray, a first tray cover coupled to the first tray, and a heater case at which the first heater is installed, wherein the heater case is integrally formed with the first tray case, and the first tray cover has an opening formed to correspond to a shape of the cell of the first tray.

13. A refrigerator comprising:

a cabinet including a storage chamber;

a door that opens and closes the storage chamber; and the ice maker of claim 9.

14. An ice maker comprising:

a cell in which a liquid is phase-changed into ice;

a first tray configured to form at least a portion of a wall for providing the cell;

a second tray forming at least another portion of the wall for providing the cell;

a first tray case coupled to the first tray;

a first heater to transfer heat to the first tray so that the ice is separated from a surface of the first tray; and a heater case at which the first heater is installed, wherein the heater case is integrally formed with the first tray case, wherein the ice is separated from the first tray through at least two heating processes of the first heater, wherein the at least two heating processes of the first heater comprise:

a first heating process performed by operating the first heater, and a second heating process performed by operating the first heater and performed after the first heating process, wherein in a state in which the first tray is in contact with the second tray, the first heating process is performed, wherein the second tray is capable of being moved after the first heating process, and wherein after the second tray is moved, the second heating process is performed.

15. The ice maker of claim 14, further comprising a bracket inside or outside which a portion of the ice maker is provided, the bracket being formed as a separate component from the first tray.

16. The ice maker of claim 15, wherein the first tray case and the bracket are integrally provided.

17. The ice maker of claim 15, wherein the first tray case and the bracket are coupled to each other after the first tray case is manufactured as a separate component from the bracket.

18. The ice maker of claim 14, further comprising a first tray cover coupled to the first tray, wherein the first tray cover has an opening formed to correspond to a shape of the cell of the first tray, and wherein the first tray cover is disposed outside the cell or a portion of the first tray passes through the opening of the first tray cover.

19. The ice maker of claim 14, wherein after the second heating process is ended, the second tray moves toward an ice separation position, and wherein after the second tray is moved to the ice separation position, the second tray moves toward a liquid supply position.

20. A refrigerator comprising:

a cabinet including a storage chamber;

a door that opens and closes the storage chamber; and the ice maker of claim 14.

21. The ice maker of claim 14, wherein the first tray is made of flexible material or soft material, and the first tray case is in contact with the portion of the wall for providing the cell.

* * * * *